US011174529B2

(12) United States Patent
Okamoto et al.

(10) Patent No.: US 11,174,529 B2
(45) Date of Patent: Nov. 16, 2021

(54) HIGH-STRENGTH STEEL SHEET AND METHOD OF MANUFACTURING THE SAME

(71) Applicant: NIPPON STEEL & SUMITOMO METAL CORPORATION, Tokyo (JP)

(72) Inventors: Riki Okamoto, Tokyo (JP); Yoshinari Ishida, Tokyo (JP); Yoshihiro Suwa, Tokyo (JP); Takafumi Yokoyama, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 849 days.

(21) Appl. No.: 15/571,619

(22) PCT Filed: May 6, 2016

(86) PCT No.: PCT/JP2016/063660
§ 371 (c)(1),
(2) Date: Nov. 3, 2017

(87) PCT Pub. No.: WO2016/178430
PCT Pub. Date: Nov. 10, 2016

(65) Prior Publication Data

US 2018/0148809 A1 May 31, 2018

(30) Foreign Application Priority Data

May 7, 2015 (JP) ..... JP2015-095157
May 7, 2015 (JP) ..... JP2015-095158

(51) Int. Cl.
*C22C 38/60* (2006.01)
*C22C 38/00* (2006.01)
(Continued)

(52) U.S. Cl.
CPC ..... *C21D 9/46* (2013.01); *C21D 6/001* (2013.01); *C21D 6/002* (2013.01); *C21D 6/005* (2013.01);
(Continued)

(58) Field of Classification Search
None
See application file for complete search history.

(56) References Cited

U.S. PATENT DOCUMENTS

2010/0132850 A1* 6/2010 Ono ..... C22C 38/24 148/533
2012/0037281 A1* 2/2012 Ono ..... C22C 38/002 148/533
(Continued)

FOREIGN PATENT DOCUMENTS

EP 2184374 A1 5/2010
EP 2392683 A1 12/2011
(Continued)

OTHER PUBLICATIONS

Extended European Search Report for corresponding European Application No. 16789566.3, dated Nov. 20, 2018.
(Continued)

*Primary Examiner* — Anthony J Zimmer
*Assistant Examiner* — Michael J Kachmarik
(74) *Attorney, Agent, or Firm* — Birch, Stewart, Kolasch & Birch, LLP

(57) ABSTRACT

A high-strength steel sheet having a microstructure represented by, in area %, martensite: 5% or more; ferrite: 20% or more; and pearlite: 5% or less. A ratio of the number of bulging type martensite grains to the number of martensite grains on grain boundary triple points of a matrix is 70% or more, wherein: the bulging type martensite grain is on one of the grain boundary triple points of the matrix; and at least
(Continued)

one of grain boundaries of the bulging type martensite grain, the grain boundaries connecting two adjacent grain boundary triple points of the bulging type martensite grain and grains of the matrix, has a convex curvature to an outer side with respect to line segments connecting the two adjacent grain boundary triple points. An area ratio VM/A0 is 1.0 or more.

17 Claims, 9 Drawing Sheets

(51) Int. Cl.

| | |
|---|---|
| ***C22C 38/02*** | (2006.01) |
| ***C22C 38/06*** | (2006.01) |
| ***C22C 38/08*** | (2006.01) |
| ***C22C 38/16*** | (2006.01) |
| ***C22C 38/26*** | (2006.01) |
| ***C22C 38/28*** | (2006.01) |
| ***C22C 38/38*** | (2006.01) |
| ***C21D 9/46*** | (2006.01) |
| ***C21D 6/00*** | (2006.01) |
| ***C21D 8/02*** | (2006.01) |

(52) U.S. Cl.

CPC ..... *C21D 6/008* (2013.01); *C21D 8/0205* (2013.01); *C21D 8/0226* (2013.01); *C21D 8/0236* (2013.01); *C21D 8/0247* (2013.01); *C22C 38/00* (2013.01); *C22C 38/001* (2013.01); *C22C 38/002* (2013.01); *C22C 38/005* (2013.01); *C22C 38/02* (2013.01); *C22C 38/06* (2013.01); *C22C 38/08* (2013.01); *C22C 38/16* (2013.01); *C22C 38/26* (2013.01); *C22C 38/28* (2013.01); *C22C 38/38* (2013.01); *C22C 38/60* (2013.01); *C21D 2211/005* (2013.01); *C21D 2211/008* (2013.01); *C21D 2211/009* (2013.01)

(56) References Cited

U.S. PATENT DOCUMENTS

| | | | | |
|---|---|---|---|---|
| 2014/0102597 | A1 | 4/2014 | Ono et al. | |
| 2016/0177414 | A1 | 6/2016 | Takashima et al. | |
| 2016/0186299 | A1* | 6/2016 | Minami | C22C 38/002 428/659 |
| 2018/0127856 | A1* | 5/2018 | Takashima | C21D 6/008 |

FOREIGN PATENT DOCUMENTS

| | | | |
|---|---|---|---|
| EP | 2799568 | A1 | 11/2014 |
| JP | 2004-308002 | A | 11/2004 |
| JP | 2010-285636 | A | 12/2010 |
| JP | 2014-173151 | A | 9/2014 |
| WO | WO 2010/087529 | A1 | 8/2010 |
| WO | WO 2015/015738 | A1 | 2/2015 |
| WO | WO 2015/019558 | A1 | 2/2015 |

OTHER PUBLICATIONS

International Search Report for PCT/JP2016/063660 dated Aug. 9, 2016.

Written Opinion of the International Searching Authority for PCT/JP2016/063660 (PCT/ISA/237) dated Aug. 9, 2016.

The International Preliminary Report on Patentability and English translation of the Written Opinion of the International Searching Authority (Forms PCT/IB/338, PCT/IB/373 and PCT/ISA/237), dated Nov. 16, 2017, for International Application No. PCT/JP2016/063660.

* cited by examiner

HIGH-STRENGTH STEEL SHEET AND METHOD OF MANUFACTURING THE SAME

TECHNICAL FIELD

The present invention relates to a high-strength steel sheet suitable for automobiles and a method of manufacturing the same.

BACKGROUND ART

There is a growing demand for reduction of car body weight as a measure for improving fuel economy of automobiles and cost reduction by integral forming of components, and the development of high-strength steel sheets excellent in press formability is under way. A dual phase steel sheet (DP steel sheet) including ferrite and martensite and a TRIP steel sheet utilizing transformation induced plasticity (TRIP) of retained austenite are known as a high-strength steel sheet excellent in press formability.

However, in the conventional DP steel sheet and the TRIP steel sheet, improvement of local ductility is limited, and it is difficult to manufacture a member which is complicated in shape and desired to have high-strength. From the viewpoint of mechanical properties, it is difficult to obtain good local ductility while obtaining high tensile strength. As indicators of local ductility, a hole expandability and a reduction of area are cited. According to a hole expansion test, in a stretch flange formed part and the like, evaluation close to an actual forming can be performed, but it is evaluated on the characteristic of the crack generation part (direction). On the other hand, since the reduction of area is measured by a tensile test that defines the deformation direction, it is easy to indicate the quantitative difference of the local ductility of the material. For example, Patent Reference 1 describes a high-strength hot-rolled steel sheet for improving fatigue strength, but it is sometimes difficult to manufacture a member having a complicated shape with the steel sheet.

CITATION LIST

Patent Reference

Patent Reference 1: Japanese Laid-open Patent Publication No. 2014-173151

SUMMARY OF INVENTION

Technical Problem

It is an object of the present invention to provide a high-strength steel sheet capable of improving local ductility while securing high-strength and a method of manufacturing the same.

Solution to Problem

The inventors of the present invention conducted diligent studies to clarify the reason why excellent local ductility cannot be obtained in a conventional high-strength steel sheet. As a result, it has been found that, among martensite grains in a conventional high-strength steel sheet, those on grain boundary triple points tend to be origins of cracking. In addition, it has been also revealed that many of the martensite grains on the grain boundary triple points have a shape susceptible to stress concentration. Furthermore, it has been found that martensite grains inevitably have a shape susceptible to stress concentration, since ferrite, bainite, or pearlite, or any combination thereof grows during cooling from a dual phase region of austenite and ferrite, and martensite grains are formed in the gap in a conventional method of manufacturing a high-strength steel sheet.

Then, the present inventors conducted intensive studies to make a shape of martensite grains on a grain boundary triple point into a shape hard to receive stress concentration. As a result, it has been found that it is important to prepare a steel sheet having a microstructure (initial structure) in which the area fraction and size of pearlite is within a specific range and reheat the steel sheet under a specific condition. Further, in order to prepare the above steel sheet, it has been also found that it is effective to perform hot rolling under a specific condition or perform annealing under a specific condition after cold rolling.

Based on such findings, the inventors of the present invention have made further diligent studies and as a result have conceived the following aspects of the invention.

(1) A high-strength steel sheet, including:

a chemical composition represented by, in mass %:

C: 0.03% to 0.35%;
Si: 0.01% to 2.0%;
Mn: 0.3% to 4.0%;
Al: 0.01% to 2.0%;
P: 0.10% or less;
S: 0.05% or less;
N: 0.010% or less;
Cr: 0.0% to 3.0%;
Mo: 0.0% to 1.0%;
Ni: 0.0% to 3.0%;
Cu: 0.0% to 3.0%;
Nb: 0.0% to 0.3%;
Ti: 0.0% to 0.3%;
V: 0.0% to 0.5%;
B: 0.0% to 0.1%;
Ca: 0.00% to 0.01%;
Mg: 0.00% to 0.01%;
Zr: 0.00% to 0.01%;
REM: 0.00% to 0.01%; and
the balance: Fe and impurities, and a microstructure represented by, in area %, martensite: 5% or more;
ferrite: 20% or more; and
pearlite: 5% or less, wherein an average diameter of martensite grain is 4 μm or less in equivalent circle diameter, a ratio of the number of bulging type martensite grains to the number of martensite grains on grain boundary triple points of a matrix is 70% or more, wherein:

the bulging type martensite grain is on one of the grain boundary triple points of the matrix; and at least one of grain boundaries of the bulging type martensite grain, the gain boundaries connecting two adjacent grain boundary triple points of the bulging type martensite grain and grains of the matrix, has a convex curvature an outer side with respect to line segments connecting the two adjacent grain boundary triple points, and an area ratio represented by VM/A0 is 1.0 or more.

VM denotes a total area of the martensite grains on the grain boundary triple points of the matrix; and A0 denotes a total area of polygons composed of the line segments connecting two adjacent grain boundary triple points of the martensite grains.

(2) The high-strength steel sheet according to (1), wherein an average diameter $D_S$ of ferrite in a surface layer portion from a surface of the high-strength steel sheet to a depth $4\times D_0$ is not more than twice an average diameter $D_0$, wherein the average diameter $D_0$ is an average diameter of ferrite in a region where a depth from the surface of the high-strength steel sheet is ¼ of a thickness of the high-strength steel sheet.

(3) The high-strength steel sheet according to (1) or (2), wherein an area fraction of unrecrystallized ferrite is 10% or less in the microstructure.

(4) The high-strength steel sheet according to any one of (1) to (3), wherein, in the chemical composition, Cr: 0.05% to 3.0%,
Mo: 0.05% to 1.0%,
Ni: 0.05% to 3.0%, or
Cu: 0.05% to 3.0%,
or any combination thereof is satisfied.

(5) The high-strength steel sheet according to any one of (1) to (4), wherein, in the chemical composition, Nb: 0.005% to 0.3%,
Ti: 0.005% to 0.3%, or
V: 0.01% to 0.5%,
or any combination thereof is satisfied.

(6) The high-strength steel sheet according to any one of (1) to (5), wherein, in the chemical composition, B: 0.0001% to 0.1% is satisfied.

(7) The high-strength steel sheet according to any one of (1) to (6), wherein, in the chemical composition, Ca: 0.0005% to 0.01%,
Mg: 0.0005% to 0.01%,
Zr: 0.0005% to 0.01%, or
REM: 0.0005% to 0.01%,
or any combination thereof is satisfied.

(8) A method of manufacturing a high-strength steel sheet, including the steps of:

preparing a steel sheet;
reheating the steel sheet to a first temperature of 770° C. to 820° C. at an average heating rate of 3° C./s to 120° C./s; and
then, cooling the steel sheet to a second temperature of 300° C. or less at an average cooling rate of 60° C./s or more,
wherein
an area fraction of pearlite is 10% or less, an area fraction of unrecrystallized ferrite is 10% or less, and an average diameter of pearlite grain is 10 μm or less in the steel sheet,
an average diameter $D_S$ of ferrite in a surface layer portion from a surface of the steel sheet to a depth $4\times D_0$ is not more than twice an average diameter $D_0$, wherein the average diameter $D_0$ is an average diameter of ferrite in a region where a depth from the surface of the steel sheet is ¼ of a thickness of the steel sheet,
the cooling to the second temperature is started within 8 seconds once the temperature of the steel sheet reaches the first temperature, and
the steel sheet includes a chemical composition represented by, in mass %:
C: 0.03% to 0.35%;
Si: 0.01% to 2.0%;
Mn: 0.3% to 4.0%;
Al: 0.01% to 2.0%;
P: 0.10% or less;
S: 0.05% or less;
N: 0.010% or less;
Cr: 0.0% to 3.0%;
Mo: 0.0% to 1.0%;
Ni: 0.0% to 3.0%;
Cu: 0.0% to 3.0%;
Nb: 0.0% to 0.3%;
Ti: 0.0% to 0.3%;
V: 0.0% to 0.5%;
B: 0.0% to 0.1%;
Ca: 0.00% to 0.01%;
Mg: 0.00% to 0.01%;
Zr: 0.00% to 0.01%;
REM: 0.00% to 0.01%; and
the balance: Fe and impurities.

(9) The method of manufacturing the high-strength steel sheet according to (8), wherein the step of preparing the steel sheet includes the step of hot-rolling and cooling a slab.

(10) The method of manufacturing the high-strength steel sheet according to (9), wherein a rolling temperature is "Ar3 point+10° C." to 1000° C., and a total reduction ratio is 15% or more in last two stands of finish rolling in the hot rolling, and
a cooling stop temperature is 550° C. or lower of the cooling in the step of preparing the steel sheet.

(11) The method of manufacturing the high-strength steel sheet according to (8), wherein the step of preparing the steel sheet includes the steps of:

hot rolling a slab to obtain a hot-rolled steel sheet; and
cold rolling, annealing and cooling the hot-rolled steel sheet.

(12) The method of manufacturing the high-strength steel sheet according to (11), wherein a reduction ratio in the cold rolling is 30% or more,
a temperature of the annealing is 730° C. to 900° C., and
an average cooling rate from the temperature of the annealing to 600° C. is 1.0° C./s to 20° C./second in cooling in the step of preparing the steel sheet.

(13) The method of manufacturing the high-strength steel sheet according to any of (8) to (12), wherein, in the chemical composition, Cr: 0.05% to 3.0%,
Mo: 0.05% to 1.0%,
Ni: 0.05% to 3.0%, or
Cu: 0.05% to 3.0%,
or any combination thereof is satisfied.

(14) The method of manufacturing the high-strength steel sheet according to any of (8) to (13), wherein, in the chemical composition, Nb: 0.005% to 0.3%,
Ti: 0.005% to 0.3%, or
V: 0.01% to 0.5%,
or any combination thereof is satisfied.

(15) The method of manufacturing the high-strength steel sheet according to any of (8) to (14), wherein, in the chemical composition, B: 0.0001% to 0.1% is satisfied.

(16) The method of manufacturing the high-strength steel sheet according to any of (8) to (15), wherein, in the chemical composition, Ca: 0.0005% to 0.01%,
Mg: 0.0005% to 0.01%,
Zr: 0.0005% to 0.01%, or
REM: 0.0005% to 0.01%,
or any combination thereof is satisfied.

Advantageous Effects of Invention

According to the present invention, since the shape of martensite grain is appropriate, it is possible to improve the local ductility while securing high strength.

DESCRIPTION OF EMBODIMENTS

Figure 1A:
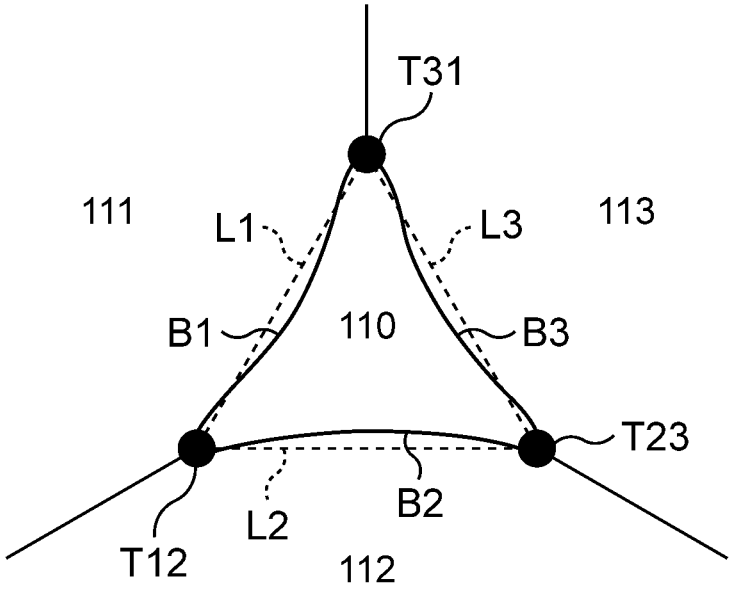
FIG. 1A is a view illustrating an example of a shape of a martensite grain.

The present inventors observed microstructures of high-strength steel sheets manufactured by cooling with a runout table after hot rolling and microstructures of high-strength steel sheets manufactured by annealing after cold rolling (hereinafter sometimes referred to as "cold-rolled sheet annealing"). As a result of the observation, as illustrated in FIG. 1A, it has been revealed that grains 111, 112, and 113 of ferrite, bainite, or pearlite have grown so as to expand outward and that a martensite grain 110 is formed on the grain boundary triple point in many fields of view. In this microstructure, a grain boundary B1 between the martensite grain 110 and the grain 111 is bulging toward the martensite grain 110 side with respect to a line segment L1 connecting a grain boundary triple point T31 of the martensite grain 110, the grain 113 and the grain 111, and a grain boundary triple point T12 of the martensite grain 110, the grain 111 and the grain 112, when viewed from the martensite grain 110. A grain boundary B2' between the martensite grain 110 and the grain 112 is bulging toward the martensite grain 110 side with respect to a line segment L2 connecting the grain boundary triple point T12 and a grain boundary triple point T23 of the martensite grain 110, the grain 112 and the grain 113. A grain boundary B3 between the martensite grain 110 and the grain 113 is bulging toward the martensite grain 110 side with respect to a line segment L3 connecting the grain boundary triple point T23 and the grain boundary triple point T31. In a high-strength steel sheet having such a microstructure, the grain boundaries of the martensite grain 110 are sagging, stress tends to concentrate near the grain boundary triple points T12, T23, and T31, and cracking is likely to occur from these regions. For this reason, it is difficult to obtain excellent local ductility.

The reason for obtaining such a microstructure is considered that ferrite grains or the like grow to expand outward during cooling after hot rolling at a run-out table or cooling after cold-rolled sheet annealing, and martensite generates in the remaining area thereafter.

Figure 1B:
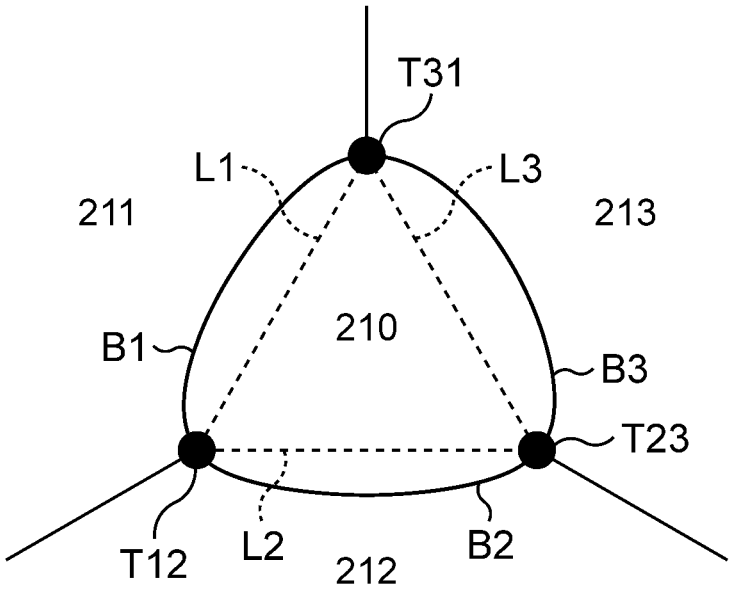
FIG. 1B is a view illustrating another example of a shape of a martensite grain.

As a result of intensive investigation by the present inventors on the microstructure capable of obtaining excellent local ductility with reference to the observation results as described above, it has been found that a microstructure as illustrated in FIG. 1B is suitable for improving the local ductility. That is, it has been found that a microstructure in which a martensite grain 210 bulges outward and is surrounded by grains 211, 212, and 213 of a matrix such as ferrite is preferable. In this microstructure, a grain boundary B1 between the martensite grain 210 and the grain 211 is bulging toward the grain 211 side with a line segment L1 connecting a grain boundary triple point T31 of the martensite grain 210, the grain 213, and the grain 211, and a grain boundary triple point T12 of the martensite grain 210, the grain 211, and the grain 212, when viewed from the martensite grain 210. A grain boundary B2 between the martensite grain 210 and the grain 212 is bulging toward the grain 212 side with respect to a line segment L2 connecting the grain boundary triple point T12 and the grain boundary triple point T23 of the martensite grain 210, the grain 212, and the grain 213, when viewed from the martensite grain 210. A grain boundary B3 between the martensite grain 210 and the grain 213 is bulging toward the grain 213 side with respect to a line segment L3 connecting the grain boundary triple point T23 and the grain boundary triple point T31, when viewed from the martensite grain 210. In a high-strength steel sheet having such a microstructure, the grain boundaries of the martensite grain 210 are bulging outward, stress is hardly concentrated near the grain boundary triple points T12, T23, and T31, and excellent local ductility can be obtained. A high-strength steel sheet having such a microstructure may be manufactured by a method described later.

Hereinafter, embodiments of the present invention will be described.

First, the chemical compositions of the high-strength steel sheet according to the embodiment of the present invention and a steel used for manufacturing the high-strength steel sheet will be described. Though details will be described later, the high-strength steel sheet according to the embodiment of the present invention is manufactured through hot rolling, cooling, and reheating or through hot rolling, cold rolling, cold-rolled sheet annealing, cooling, and heat treatment. Accordingly, the chemical compositions of the high-strength steel sheet and the steel are ones in consideration of not only characteristics of the high-strength steel sheet but also the above-stated processing. In the following description, "%" being a unit of a content of each element contained in the high-strength steel sheet and the steel means "mass %" unless otherwise specified. The high-strength steel sheet according to the present embodiment and the steel used for the manufacturing the same contain, by mass %, C: 0.03% to 0.35%, Si: 0.01% to 2.0%, Mn: 0.3% to 4.0%, Al: 0.01% to 2.0%, P: 0.10% or less, S: 0.05% or less, N: 0.010% or less, Cr: 0.0% to 3.0%, Mo: 0.0% to 1.0%, Ni: 0.0% to 3.0%, Cu: 0.0% to 3.0%, Nb: 0.0% to 0.3%, Ti: 0.0% to 0.3%, V: 0.0% to 0.5%, B: 0.0% to 0.1%, Ca: 0.00% to 0.01%, Mg: 0.00% to 0.01%, Zr: 0.00% to 0.01%, rare earth metal (REM): 0.00% to 0.01%, and the balance: Fe and impurities.

Examples of the impurities include one contained in raw materials such as ore and scrap, and one contained during a manufacturing process. Sn and As may be examples of impurities.

(C: 0.03% to 0.35%)

C contributes to improvement in strength through strengthening of martensite. When a C content is less than 0.03%, sufficient strength, for example, tensile strength of 500 $N/m^2$ or more cannot be obtained. Therefore, the C content is 0.03% or more. On the other hand, when the C content exceeds 0.35%, the area fraction and size of pearlite in the initial structure after hot rolling and cooling are increased, the area fraction of pearlite and island-shaped cementite in a microstructure after reheating is increased, and therefore sufficient local ductility cannot be obtained. Therefore, the C content is 0.35% or less. The C content is preferably 0.25% or less in order to obtain higher local ductility, and the C content is preferably 0.1% or less in order to obtain more excellent hole expandability.

(Si: 0.01% to 2.0%)

Si is a ferrite former element and promotes the formation of ferrite in cooling after the hot rolling. Si also contributes to improvement of workability by suppressing the generation of harmful carbides and contributes to improvement in strength through solid solution strengthening. When a Si content is less than 0.01%, these effects cannot be obtained sufficiently. Therefore, the Si content is 0.01% or more. When the Si content is less than 0.1%, the Si content is preferably 0.3% or more. On the other hand, when the Si content exceeds 2.0%, the chemical conversion property and spot weldability are deteriorated. Therefore, the Si content is 2.0% or less.

(Mn: 0.3% to 4.0%)

Mn contributes to improvement in strength. When a Mn content is less than 0.3%, sufficient strength cannot be obtained. Therefore, the Mn content is 0.3% or more. On the other hand, when the Mn content exceeds 4.0%, micro segregation and macro segregation are likely to occur, and local ductility and hole expandability are deteriorated. Therefore, the Mn content is 4.0% or less.

(Al: 0.01% to 2.0%)

Al acts as a deoxidizer. When an Al content is less than 0.01%, oxygen may not be sufficiently excluded in some cases. Therefore, the Al content is 0.01% or more. Like Si, Al promotes the formation of ferrite and suppresses the formation of harmful carbides and contributes to the improvement of workability. Also, Al does not affect the chemical conversion property as much as Si. Therefore, Al is useful for compatibility of ductility and chemical conversion property. However, when the Al content exceeds 2.0%, the effect of improving the ductility is saturated, and the chemical conversion property and spot weldability may be deteriorated. Therefore, the Al content is 2.0% or less. The Al content is preferably 1.0% or less in order to obtain more excellent chemical conversion property.

(P: 0.10% or Less)

P is not an essential element, and is contained as an impurity in the steel, for example. Since P deteriorates weldability, workability and toughness, a lower P content is more preferable. In particular, when the P content exceeds 0.10%, weldability, workability and toughness are remarkably deteriorated. Therefore, the P content is 0.10% or less. The P content is preferably 0.03% or less in order to obtain better workability. It is costly to decrease the P content, and in order to decrease the P content to less than 0.001%, a cost increases notably. Thus, the P content may be 0.001% or more. P may improve corrosion resistance when Cu is contained.

(S: 0.05% or Less)

S is not an essential element, and is contained as an impurity in the steel, for example. Since S forms a sulfide such as MnS, and the sulfide serves as an origin of cracking, and reduces local ductility and hole expandability, a lower S content is more preferable. In particular, when the S content exceeds 0.05%, the local ductility and the hole expanding property are remarkably deteriorated. Therefore, the S content is 0.05% or less. It is costly to decrease the S content, and in order to decrease the S content to less than 0.0005%, a cost increases notably. Thus, the S content may be 0.0005% or more.

(N: 0.010% or Less)

N is not an essential element, and is contained as an impurity in the steel, for example. N causes stretcher strain and deteriorates workability. When Ti and Nb are contained, N forms (Ti, Nb) N and the precipitate serves as an origin of cracking. N may cause roughening of the end face in punching and greatly deteriorate local ductility. Therefore, a lower N content is more preferable. In particular, when the N content exceeds 0.010%, the above phenomenon is remarkable. Therefore, the N content is 0.010% or less. It is costly to decrease the N content, and in order to decrease the N content to less than 0.0005%, a cost increases notably. Therefore, the N content may be 0.0005% or more.

Cr, Mo, Ni, Cu, Nb, Ti, V, B, Ca, Mg, Zr and REM are not essential elements and are arbitrary elements which may be appropriately contained in the steel sheet and steel to the extent of a specific amount.

(Cr: 0.0% to 3.0%, Mo: 0.0% to 1.0%, Ni: 0.0% to 3.0%, Cu: 0.0% to 3.0%)

Cu contributes to improvement in strength. Cu improves corrosion resistance when P is contained. Therefore, Cu may be contained. In order to sufficiently obtain these effects, a Cu content is preferably 0.05% or more. On the other hand, when the Cu content exceeds 3.0%, the hardenability is excessive and the ductility decreases. Therefore, the Cu content is 3.0% or less. Ni facilitates the formation of martensite through improvement of hardenability. Ni contributes to suppression of hot cracking which is likely to occur when Cu is contained. Therefore, Ni may be contained. In order to sufficiently obtain these effects, a Ni content is preferably 0.05% or more. On the other hand, when the Ni content exceeds 3.0%, the hardenability is excessive and the ductility decreases. Therefore, the Ni content is 3.0% or less. Mo suppresses the formation of cementite and suppresses the formation of pearlite in the initial structure. Mo is also effective for forming martensite grains in the reheating. Therefore, Mo may be contained. In order to sufficiently obtain these effects, a Mo content is preferably 0.05% or more. On the other hand, when the Mo content exceeds 1.0%, the ductility decreases. Therefore, the Mo content is 1.0% or less. Like Cr, Cr suppresses the formation of cementite and suppresses the formation of pearlite in the initial structure. Therefore, Cr may be contained. In order to obtain this effect sufficiently, a Cr content is preferably 0.05% or more. On the other hand, when the Cr content exceeds 3.0%, the ductility decreases. Therefore, the Cr content is 3.0%.

From the above, it is understood that "Cr: 0.05% to 3.0%", "Mo: 0.05% to 1.0%", "Ni: 0.05% to 3.0%", or "Cu: 0.05% to 3.0%", or any combination thereof is preferably satisfied.

(Nb: 0.0% to 0.3%, Ti: 0.0% to 0.3%, V: 0.0% to 0.5%)

Nb, Ti, and V contribute to improvement in strength by forming carbides. Accordingly, Nb, Ti, or V, or any combination thereof may be contained. In order to sufficiently obtain this effect, a Nb content is preferably 0.005% or more, a Ti content is preferably 0.005% or more, and a V content is preferably 0.01% or more. On the other hand, when the Ni content exceeds 0.3%, the Ti content exceeds 0.3%, or the V content exceeds 0.5%, the precipitation strengthening is excessive and the workability deteriorates. Therefore, the Nb content is 0.3% or less, the Nb content is 0.3% or less, and the V content is 0.5% or less.

From the above, it is understood that "Nb: 0.005% to 0.3%", "Ti: 0.005% to 0.3%", or "V: 0.01% to 0.5%", or any combination thereof is preferably satisfied.

(B: 0.0% to 0.1%)

B contributes to improvement in strength. Therefore, B may be contained. In order to obtain this effect sufficiently, a B content is preferably 0.0001% or more. On the other hand, when the B content exceeds 0.1%, the hardenability is excessive and the ductility decreases. Therefore, the B content is 0.1% or less.

(Ca: 0.00% to 0.01%, Mg: 0.00% to 0.01%, Zr: 0.00% to 0.01%, REM: 0.00% to 0.01%)

Ca, Mg, Zr, and REM control the shape of sulfide-based inclusions and are effective for improving local ductility. Thus, Ca, Mg, Zr, or REM, or any combination thereof may be contained. In order to sufficiently obtain this effect, a Ca content is preferably 0.0005% or more, the Mg content is preferably 0.0005% or more, the Zr content is preferably 0.0005% or more, the REM content is preferably 0.0005% or more. On the other hand, when the Ca content exceeds 0.01%, the Mg content exceeds 0.01%, the Zr content exceeds 0.01%, the REM content exceeds 0.01%, the ductility and local ductility are deteriorated. Therefore, the Ca content is 0.01% or less, the Mg content is 0.01% or less, the Zr content is 0.01% or less, and the REM content is 0.01% or less.

From the above, it is understood that "Ca: 0.0005% to 0.01%", "Mg: 0.0005% to 0.01%", "Zr: 0.0005% to 0.01%", or "REM: 0.0005% to 0.01%", or any combination thereof is preferably satisfied.

REM (rare earth metal) indicates elements of 17 kinds in total of Sc, Y, and lanthanoid, and a "REM content" means a total content of these elements of 17 kinds. Lanthanoid is industrially added as a form of misch metal, for example.

Next, the microstructure of the high-strength steel sheet according to the embodiment of the present invention will be described. In the following description, "%" being is a unit of phase or structure contained in the high-strength steel sheet means "area %" unless otherwise specified. The high-strength steel sheet according to the embodiment of the present invention includes a microstructure represented, by area %, martensite: 5% or more, ferrite: 20% or more, and pearlite: 5% or less.

(Martensite: 5% or More)

Martensite contributes to the improvement of strength in a Dual Phase steel (DP steel). When an area fraction of martensite is less than 5%, sufficient strength, for example, tensile strength of 500 $N/m^2$ or more cannot be obtained. Therefore, the area fraction of martensite is 5% or more. The area fraction of martensite is preferably 10% or more in order to obtain superior strength. On the other hand, when the area fraction of martensite exceeds 60%, sufficient elongation cannot be obtained in some cases. Therefore, the area fraction of martensite is preferably not more than 60%.

(Ferrite: 20% or More)

Ferrite contributes to the improvement of elongation in a DP steel. When an area fraction of ferrite is 20% or less, sufficient elongation cannot be obtained. Therefore, the area fraction of ferrite is 20% or more. The area fraction of ferrite is preferably 30% or more in order to obtain better elongation.

(Pearlite: 5% or Less)

Pearlite is not essential, and it may be formed in the manufacturing process of high-strength steel sheet. Since pearlite reduces elongation and hole expandability of a DP steel, a lower area faction of pearlite is more preferable. In particular, when the area fraction of pearlite exceeds 5%, the reduction in elongation and hole expandability is remarkable. Therefore, the area fraction of pearlite is 5% or less.

The balance of the microstructure is, for example, bainite or retained austenite or both of them.

Here, the configuration of martensite will be described in detail. In the present embodiment, an average diameter of martensite is 4 μm or less in equivalent circle diameter, a ratio of a number of bulging type martensite grains to a number of martensite grains on grain boundary triple points of a matrix is 70% or more, and a particular area ratio of 1.0 or more.

(Average Diameter of Martensite: 4 μm or Less in Equivalent Circle Diameter)

When an average diameter of martensite is more than 4 μm in equivalent circle diameter, stress tends to concentrate on martensite and cracks are likely to occur. Therefore, the average diameter of martensite is 4 μm or less in equivalent circle diameter. In order to obtain better formability, the average diameter of martensite is preferably 3 μm or less in equivalent circle diameter.

(Ratio of a Number of Bulging Type Martensite Grains to a Number of Martensite Grains on Grain Boundary Triple Points of a Matrix: 70% or More)

Figure 2:
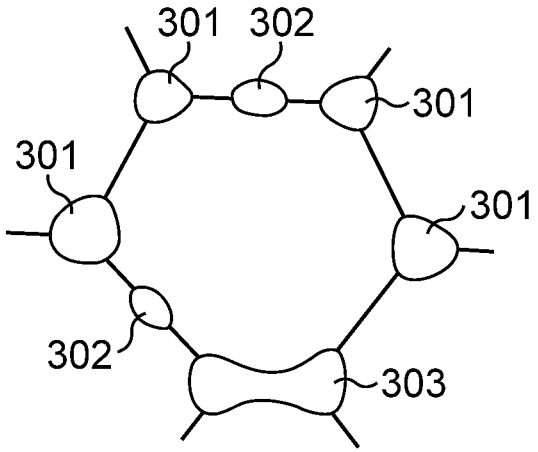
FIG. 2 is a view illustrating formation sites of martensite grains.
Figure 3:
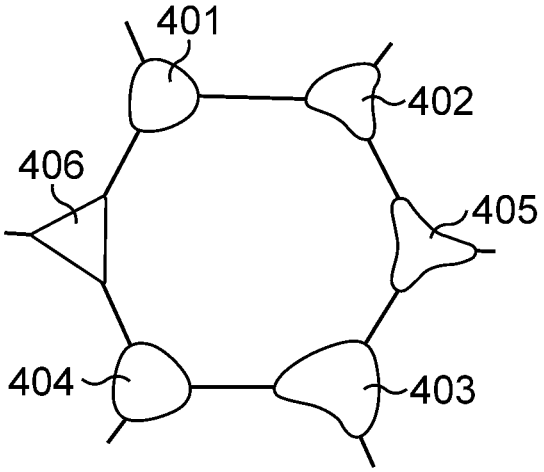
FIG. 3 is a view illustrating various shapes of martensite grains.

A bulging type martensite grain is one of martensite grains among martensite grains on grain boundary triple points of a matrix. The bulging type martensite grain is on one of the grain boundary triple points of the matrix, and at least one of whose grain boundaries of the bulging type martensite grain, the grain boundaries connecting two adjacent grain boundary triple points of the bulging type martensite grain and grains of the matrix, has a convex curvature to an outer side with respect to line segments connecting the two adjacent grain boundary triple points. As illustrated in FIG. 2, a martensite grain 301 on a grain boundary triple point of a matrix and a martensite grain 302 on a grain boundary between two grains of the matrix are included in a high-strength steel sheet, and the bulging type martensite grain belong to the martensite grain 301. The martensite grains on the grain boundary triple point include a martensite grain 303 composed by combining two or more martensite grains on grain boundary triple points. However, the martensite grain 303 is not "on one of the grain boundary triple points of the matrix", so it does not belong to the bulging type martensite grain. Among the six martensite grains illustrated in FIG. 3, the martensite grains 401, 402, 403 and 404 belong to the bulging type martensite grain, since at least one of the grain boundaries of each of the grains, the grain boundaries connecting two adjacent grain boundary triple points of the martensite grain and grains of the matrix, has a convex curvature to an outer side with respect to line segments connecting the two adjacent grain boundary triple points. On the other hand, the martensite grains 405 and 406 do not belong to the bulging type martensite grain, since all the grain boundaries of each of the grains, the grain boundaries connecting two adjacent grain boundary triple points of the martensite grain and grains of the matrix, do not have a convex curvature to an outer side with respect to line segments connecting the two adjacent grain boundary triple points.

The higher the ratio of the number of the bulging type martensite grains is, the less stress concentration occurs and excellent local ductility can be obtained. When the ratio of the number of the bulging type martensite grains to the number of the martensite grains on the grain boundary triple points of the matrix is less than 70%, the ratio of martensite grains which are likely to cause stress concentration is high and excellent local ductility cannot be obtained. Therefore, the ratio of the number of the bulging type martensite grains to the number of the martensite grains on the grain boundary triple points of the matrix is 70% or more.

(Particular Area Ratio: 1.0 or More)

Figure 4A:
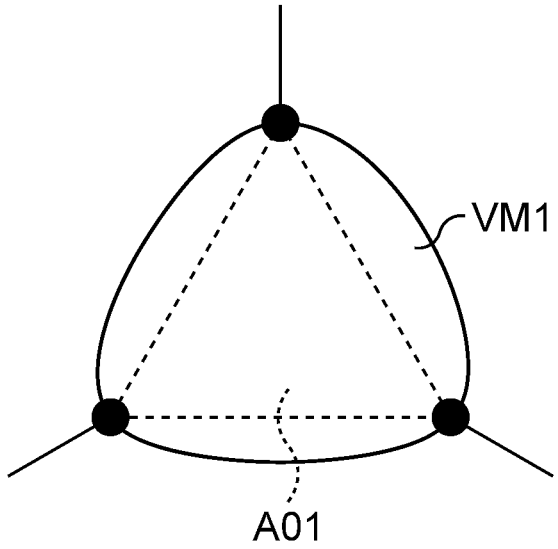
FIG. 4A is a view illustrating an example of a relationship between an area of a martensite grain and an area of a polygon.
Figure 4B:
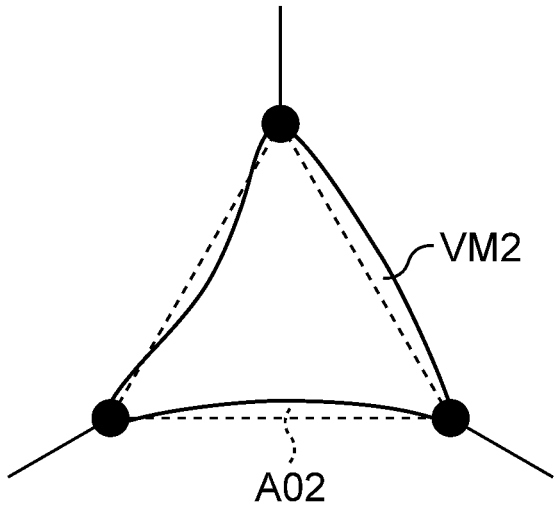
FIG. 4B is a view illustrating another example of a relationship between an area of a martensite grain and an area of a polygon.
Figure 4C:
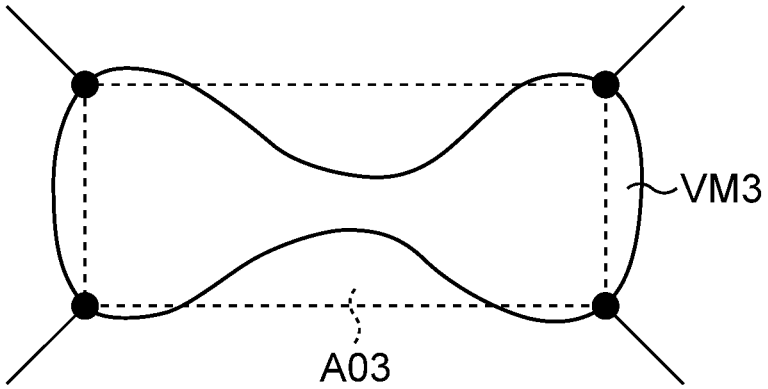
FIG. 4C is a view illustrating still another example of a relationship between an area of a martensite grain and an area of a polygon.

The bulging type martensite grains may include those in which a ratio of convex portions having convex curvature outward with respect to a line segment is greater than or equal to a ratio of concave portions having convex curvature inward, and the others not. The former ones are more likely to contribute to the improvement of local ductility than the latter ones, and the higher the area fraction of the latter ones, the lower the local ductility. As for the former bulging type martensite grain, as illustrated in FIG. 4A, an area VM1 of the bulging type martensite grain is equal to or larger than an area A01 of a polygon composed of the line segments connecting two adjacent grain boundary triple points of the bulging type martensite grain. On the other hand, as for the latter bulging type martensite grain, as illustrated in FIG. 4B, an area VM2 of the bulging martensite grain is smaller than an area A02 of a polygon that is composed of the line segments connecting two adjacent grain boundary triple points of the bulging martensite grain. In addition, although not belonging to the bulging type martensite grain, as for martensite grains on plural grain boundary triple points of the matrix like the martensite grain 303 in FIG. 2, as illustrated in FIG. 4C, an area VM3 of the martensite grain is sometimes smaller than an area A03 of a polygon that is composed of the line segments connecting two adjacent grain boundary triple points of the martensite grain. When an area ratio represented by VM/A0 is less than 1.0, it is difficult to obtain sufficient local ductility even if the ratio of the bulging type martensite grains is 70% or more. Here, VM denotes a total area of a plurality of, for example, 200 or more, martensite grains on grain boundary triple points, and A0 denotes a total area of polygons composed of the line segments connecting two adjacent grain boundary triple points of the plurality of martensite grains. Therefore, the particular area ratio represented by VM/A0 is 1.0 or more.

Figure 5:
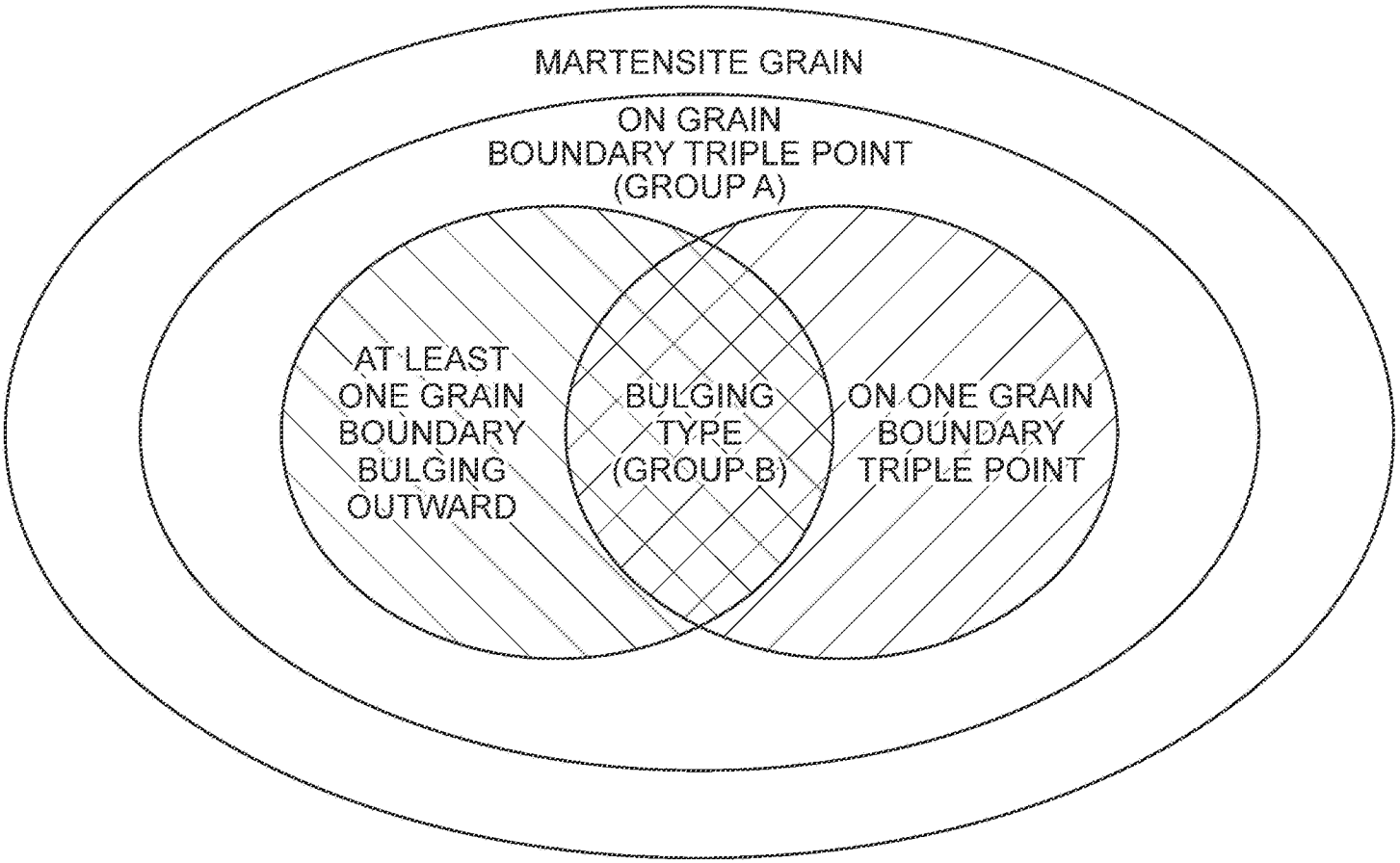
FIG. 5 is a diagram illustrating an inclusion relationship of martensite grains.

FIG. 5 illustrates an inclusion relationship of martensite grains in the present embodiment. In the present embodiment, the ratio of the number of the bulging type martensite grains (group B) to the number of the martensite grains on the grain boundary triple points of the matrix (group A) is 70% or more, and as for the martensite grains on the grain boundary triple points of the matrix (group A), the area ratio represented by VM/A0 is 1.0 or more.

According to the present embodiment, it is possible to obtain a tensile strength of 500 $N/mm^2$ or more and a reduction of area RA of 0.5 or less, for example. As a product (TS×EL) showing the balance between the tensile strength TS and the elongation EL, a value of 18000 $N/mm^2 \cdot \%$ or more can be obtained. Then, it is possible to obtain excellent local ductility as compared with a conventional high-strength steel sheet having the same level tensile strength.

A hot-dip galvanized layer may be included in the high-strength steel sheet. When a hot-dip galvanizing layer is included, more excellent corrosion resistance can be obtained. The coating weight is not particularly limited, but the coating weight is preferably 5 $g/m^2$ or more per one side in order to obtain particularly good corrosion resistance.

Preferably, the hot-dip galvanized layer contains Zn and Al, for example, and the Fe content thereof is 13% or less. A hot-dip galvanized layer having an Fe content of 13% or less is excellent in plating adhesion, formability and hole expandability. On the other hand, when the Fe content exceeds 13%, the adhesion of the hot-dip galvanized layer itself is low, and the hot-dip galvanized layer may be broken or fall off during processing of the high-strength steel sheet and adheres to a mold, it may cause scratches.

The hot-dip galvanized layer may be alloyed. Since Fe is incorporated from the base steel sheet into the alloyed hot-dip galvanized layer, excellent spot weldability and coatability are obtained. The Fe content of the alloyed hot-dip galvanized layer is preferably 7% or more. When the Fe content is less than 7%, the effect of improving spot weldability may be insufficient in some cases. As long as the Fe content of the hot-dip galvanized layer not alloyed is less than 13%, it may be less than 7% or substantially 0%, and good plating adhesion, formability and hole expandability can be obtained.

The high-strength steel sheet may contain an over-plating layer on the hot-dip galvanized layer. When the over-plating layer is included, excellent coatability and weldability can be obtained. Further, the high-strength steel sheet including the hot-dip galvanized layer may be subjected to a surface treatment such as a chromate treatment, a phosphate treatment, a lubricity improving treatment and a weldability improving treatment.

Figure 6A:
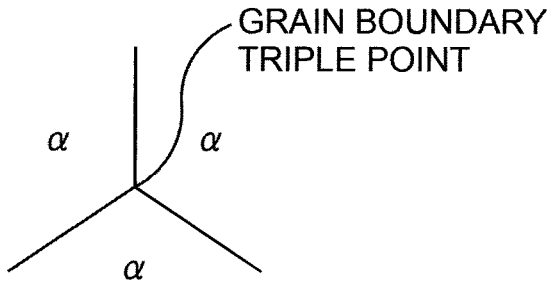
FIG. 6A is a view illustrating a change in microstructure.
Figure 6B:
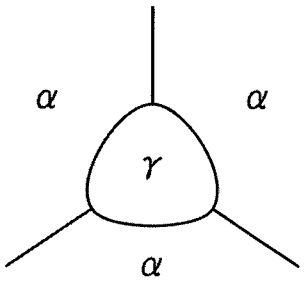
FIG. 6B is a view illustrating a change in microstructure subsequent to FIG. 6A.
Figure 6C:
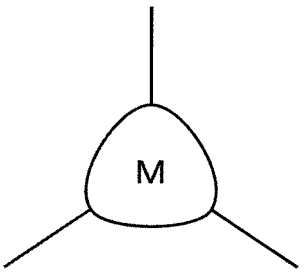
FIG. 6C is a view illustrating a change in microstructure subsequent to FIG. 6B.

Next, a first example of a method of manufacturing the high-strength steel sheet according to the embodiment of the present invention will be described. In the first example, hot rolling of the slab having the above chemical composition, cooling and reheating are performed in this order. FIG. 6A to FIG. 6C are views illustrating changes in microstructure. A microstructure of a steel sheet obtained through hot rolling and subsequent cooling (initial structure) has a low pearlite area fraction and a small average diameter of pearlite. The balance of the initial structure is, for example, ferrite ($\alpha$) (FIG. 6A). In the subsequent reheating, the steel sheet is heated to the dual phase region, and austenite ($\gamma$) is grown on the grain boundary triple point of ferrite (FIG. 6B). The austenite growing on the grain boundary triple point has an outwardly bulging shape. Then, austenite is transformed into martensite (M) by quenching from the dual phase region (FIG. 6C). As a result, martensite grains having a bulge outward are obtained. Hereinafter, these processes will be described in detail.

(Hot Rolling and Cooling)

A steel sheet is obtained by hot rolling and subsequent cooling. The microstructure (initial structure) of the steel sheet is such that an area fraction of pearlite is 10% or less and an average diameter of pearlite is 10 μm or less in equivalent circle diameter. Cementite is included in pearlite, and cementite dissolves in the reheating and inhibits the formation of austenite. When the area fraction of pearlite exceeds 10%, a sufficient amount of austenite cannot be obtained in the reheating, and as a result, it is difficult to make the area fraction of martensite in the high-strength steel sheet 5% or more. Therefore, the area fraction of pearlite is 10% or less. When also the average diameter of pearlite is more than 10 μm in equivalent circle diameter, a sufficient amount of austenite cannot be obtained in the reheating, and as a result, it is difficult to make the area fraction of martensite in the high-strength steel sheet 5% or more. When the average diameter of pearlite is more than 10 μm in equivalent circle diameter, austenite grows even in pearlite, and some of austenite may be bonded to each other. The shape of austenite grain obtained by combining a plurality of austenite grains is difficult to have a shape bulging outward. Therefore, the average diameter of pearlite is 10 μm or less in equivalent circle diameter.

The balance of the initial structure of the steel sheet is not particularly limited, and is preferably ferrite, bainite, or martensite, or any combination thereof, and in particular, the area fraction of one of these is preferably 90% or more. This is to facilitate the growth of austenite from the grain boundary triple point in the reheating. The average diameter of grains of ferrite, bainite, or martensite, or any combination thereof is preferably 10 μm or less in equivalent circle diameter. This is for reducing the martensite grain in the high-strength steel sheet. Lump cementite may be contained in the balance of the initial structure of the steel sheet, but since it inhibits the formation of austenite in the reheating, the area fraction of the lump cementite is preferably 1% or less.

It is preferable that the ferrite grains in a surface layer portion of the steel sheet be small. Ferrite does not transform in the reheating, and remains as it is on the high-strength steel sheet. Since the cold rolling is not performed in the first example, the high-strength steel sheet is thick, and strain in the surface layer portion in forming such as bending, hole expanding, and bulging tends to be larger than internal strain. Accordingly, when the ferrite grains in the surface layer portion of the high-strength steel sheet are large, cracks may occur in the surface layer portion, and the local ductility may decrease. Supposing that an average diameter of ferrite in a region where the depth from the surface of the steel sheet is ¼ of the thickness of the steel sheet is $D_0$, in order to suppress such cracking of the surface layer portion, an average diameter $D_S$ of ferrite in the surface layer portion from the surface of the steel sheet to the depth $4\times D_0$ is not more than twice the average diameter $D_0$. Hereinafter, a portion where the average diameter $D_S$ of ferrite in the surface layer portion is more than twice the average diameter $D_0$ may be referred to as a surface coarse grain layer.

The conditions for the hot rolling are not particularly limited, and in the rolling of the last two stands of the finish rolling, the temperature is preferably "Ar3 point+10° C." to 1000° C., and the total reduction ratio is preferably 15% to 45%. The thickness after the hot rolling is, for example, 1.0 mm to 6.0 mm.

When the rolling temperature in any of the last two stands is lower than Ar3 point+10° C., the surface coarse grain layer is likely to be formed. Therefore, the rolling temperature in both of the last two stands is preferably Ar3 point+10° C. or more. On the other hand, when the rolling temperature exceeds 1000° C. in any of the last two stands, the average diameter of pearlite in the initial structure is not easily 10 μm or less in equivalent circle diameter. Therefore, the rolling temperature in both of the last two stands is preferably 1000° C. or less.

When the total reduction ratio of the last two stands is less than 15%, the austenite grains easily become large and the average diameter of pearlite in the initial structure is not easily 10 μm or less in equivalent circle diameter. Therefore, the total reduction ratio of the last two stands is preferably 15% or more, and more preferably 20% or more. On the other hand, when the total reduction ratio exceeds 45%, it is difficult to adversely affect the mechanical properties of the steel sheet, but it may be difficult to control the shape of the steel sheet. Therefore, the total reduction ratio of the last two stands is preferably 45% or less, and more preferably 40% or less.

After the hot rolling, the steel sheet is cooled to 550° C. or lower. When the cooling stop temperature exceeds 550° C., the area fraction of pearlite exceeds 10%. This cooling is performed, for example, with a run-out table (ROT). For example, a part or all of austenite transforms into ferrite in the cooling. The cooling condition is not particularly limited, and a part or all of austenite may be transformed into bainite, or martensite, or both. Thus, a steel sheet having a specific initial structure is obtained. The steel sheet is coiled after the cooling. For example, the coiling temperature is 550° C. or lower. When the coiling temperature exceeds 550° C., the area fraction of pearlite exceeds 10%.

(Reheating)

In the reheating, the steel sheet is heated to a first temperature of 770° C. to 820° C. at an average heating rate of 3° C./s to 120° C./s, and the steel sheet is cooled to a second temperature of 300° C. or less at an average cooling rate of 60° C./s or more. The cooling to the second temperature starts within 8 seconds once the temperature of the steel sheet reaches the first temperature. As described above, austenite grains bulging outward are grown in the reheating, and martensite grains having the same shape are obtained.

When the average heating rate is less than 3° C./s, austenite grows excessively during the heating and austenite grains bind to each other, making it difficult to obtain desired martensite in the high-strength steel sheet. Therefore, the average heating rate is 3° C./s or more. On the other hand, when the average heating rate exceeds 120° C./s, the carbide remains, and a sufficient amount of austenite cannot be obtained. Accordingly, the average heating rate is 120° C./s or less.

When the achieved temperature (first temperature) is lower than 770° C., if bainite or martensite or both of them are contained in the initial structure, these are hardly transformed into austenite and, it is difficult to obtain the desired martensite. Therefore, the achieved temperature is 770° C. or higher. That is, in the present embodiment, when bainite or martensite or both of them are contained in the initial structure, they are transformed into austenite instead of tempering. On the other hand, when the achieved temperature exceeds 820° C., ferrite transforms into austenite, and it is difficult to obtain the desired martensite in a high-strength steel sheet. Therefore, the achieved temperature is 820° C. or lower.

When the average cooling rate is less than 60° C./s, ferrite easily grows, making it difficult to obtain martensite in a shape bulging outward. Accordingly, the average cooling rate is 60° C./s or more. On the other hand, when the average cooling rate exceeds 200° C./s, adverse effects on the mechanical properties of the steel sheet are unlikely to occur, but the load on the equipment increases, the uniformity of the temperature decreases, and it is difficult to control the shape of the steel sheet. Therefore, the average cooling rate is preferably 200° C./s or less.

When the cooling stop temperature (second temperature) is higher than 300° C., quenching is insufficient and it is difficult to obtain the desired martensite in the high-strength steel sheet. Therefore, the cooling stop temperature is 300° C. or less.

When the time period from the temperature of the steel sheet reaching the first temperature to the start of the cooling to the second temperature is over 8 seconds, austenite may excessively grow, austenite grains may combine with each other, and then it is difficult to obtain the desired martensite in the high-strength steel sheet. Therefore, the holding time period until the start of the cooling is less than 8 seconds. In order to obtain particularly excellent local ductility, the holding time period is preferably 5 seconds or less.

Thus, the high-strength steel sheet according to the present embodiment may be manufactured. A high-strength steel sheet manufactured using a steel sheet including a surface coarse grain layer includes the surface coarse grain layer. In a high-strength steel sheet manufactured using a steel sheet not including a surface coarse grain layer, an average diameter $D_S$ is not more than twice an average diameter $D_0$, where $D_0$ denotes an average diameter of ferrite in a region where the depth from the surface of the high-strength steel sheet is ¼ of a thickness of the high-strength steel sheet, and $D_S$ denotes an average diameter of ferrite in a surface layer portion from the surface of the high-strength steel sheet to the depth of $4\times D_0$.

Next, a second example of a method of manufacturing the high-strength steel sheet according to the embodiment of the present invention will be described. In the second example, hot rolling of the slab having the above chemical composition, cold rolling, cold-rolled sheet annealing, cooling and reheating are performed in this order. A microstructure of a steel sheet obtained through cold-rolled sheet annealing and subsequent cooling (initial structure) has a low pearlite area fraction and a small average diameter of pearlite. The balance of the initial structure is, for example, ferrite (α) (FIG. 6A). In the subsequent reheating, the steel sheet is heated to the dual phase region, and austenite (γ) is grown on the grain boundary triple point of ferrite (FIG. 6B). The austenite growing on the grain boundary triple point has an outwardly bulging shape. Then, austenite is transformed into martensite (M) by quenching from the dual phase region (FIG. 6C). As a result, martensite grains having a bulge outward are obtained. Hereinafter, these processes will be described in detail.

(Hot Rolling)

Hot rolling of the slab is performed to obtain a hot-rolled steel sheet having a thickness of, for example, 1.0 mm to 6.0 mm.

(Cold Rolling, Cold-Rolled Sheet Annealing, and Cooling)

A steel sheet is obtained by cold rolling of the hot-rolled steel sheet, cold-rolled sheet annealing and subsequent cooling. The microstructure (initial structure) of the steel sheet is such that an area fraction of pearlite is 10% or less and an average diameter of pearlite is 10 μm or less in equivalent circle diameter, and an area fraction of unrecrystallized ferrite is 10% or less. Cementite is included in pearlite, and cementite dissolves in the reheating and inhibits the formation of austenite. When the area fraction of pearlite exceeds 10%, a sufficient amount of austenite cannot be obtained in the reheating, and as a result, it is difficult to make the area fraction of martensite in the high-strength steel sheet 5% or more. Therefore, the area fraction of pearlite is 10% or less. When also the average diameter of pearlite is more than 10 μm in equivalent circle diameter, a sufficient amount of austenite cannot be obtained in the reheating, and as a result, it is difficult to make the area fraction of martensite in the high-strength steel sheet 5% or more. When the average diameter of pearlite is more than 10 μm in equivalent circle diameter, austenite grows even in pearlite, and some of austenite may be bonded to each other. The shape of austenite grain obtained by combining a plurality of austenite grains is difficult to have a shape bulging outward. Therefore, the average diameter of pearlite is 10 μm or less in equivalent circle diameter. When the area fraction of unrecrystallized ferrite exceeds 10%, sufficient local ductility cannot be obtained. Therefore, the area fraction of unrecrystallized ferrite is 10% or less.

The balance of the initial structure of the steel sheet is not particularly limited, and is preferably ferrite, bainite, or martensite, or any combination thereof as in the first example, and in particular, the area fraction of one of these is preferably 90% or more. The average diameter of grains of ferrite, bainite, or martensite, or any combination thereof is preferably 10 μm or less in equivalent circle diameter. Lump cementite may be contained in the balance of the initial structure of the steel sheet, but the area fraction of the lump cementite is preferably 1% or less.

The conditions for the cold rolling are not particularly limited, and the reduction ratio is preferably 30% or more. When the reduction ratio is 30% or more, the grains contained in the initial structure can be made fine, and the average diameter of martensite in the high-strength steel sheet can be easily reduced to 3 μm or less. The thickness after the cold rolling is, for example, 0.4 mm to 3.0 mm.

The conditions for the cold-rolled sheet annealing are not particularly limited, and preferably the annealing temperature is 730° C. to 900° C., followed by cooling to 600° C. at an average rate of 1.0° C./s to 20° C./s.

When the annealing temperature is lower than 730° C., it is difficult to reduce the area fraction of unrecrystallized ferrite in the initial structure to 10% or less. Therefore, the annealing temperature is preferably 730° C. or higher. On the other hand, when the annealing temperature exceeds 900° C., it is difficult to make the average diameter e of pearlite in the initial structure 10 μm or less in equivalent circle diameter, and the average diameter of martensite in the high-strength steel sheet is likely to be large. Therefore, the annealing temperature is preferably 900° C. or lower.

When the average cooling rate to 600° C. is less than 1.0° C./s, the area fraction of pearlite in the initial structure exceeds 10%, or the average diameter of pearlite exceeds 10 μm in equivalent circle diameter. Therefore, the average cooling rate is preferably 1.0° C./s or more. On the other hand, when the average cooling rate to 600° C. exceeds 20° C./second, the initial structure is not stable and the desired initial structure cannot be obtained in some cases. Therefore, the average cooling rate is preferably 20° C./s or less.

When the cooling stop temperature exceeds 600° C., the area fraction of pearlite exceeds 10%. For example, a part or all of austenite transforms into ferrite in the cooling. The cooling condition is not particularly limited, and a part or all of austenite may be transformed into bainite, or martensite, or both. Thus, a steel sheet having a specific initial structure is obtained.

(Reheating)

The reheating is performed under the same conditions as in the first example. That is, the steel sheet is heated to a first temperature of 770° C. to 820° C. at an average heating rate of 3° C./s to 120° C./s, and the steel sheet is cooled to a second temperature 300° C. or less at an average cooling rate of 60° C./s or more. Cool to temperature. The cooling to the second temperature starts within 8 seconds once the temperature of the steel sheet reaches the first temperature. As described above, austenite grains bulging outward are grown in the reheating, and martensite grains having the same shape are obtained.

Thus, the high-strength steel sheet according to the present embodiment may be manufactured. A microstructure of a high-strength steel sheet manufactured using a steel sheet with an area fraction of unrecrystallized ferrite exceeding 10% includes unrecrystallized ferrite with an area fraction of exceeding 10%. An area fraction of unrecrystallized ferrite is 10% or less in a high-strength steel sheet manufactured using a steel sheet with an area fraction of unrecrystallized ferrite of 10% or less.

In the first example, since the steel sheet is prepared by hot rolling and subsequent cooling, this steel sheet does not include more than 10% of unrecrystallized ferrite. In the second example, since the steel sheet is prepared by cold rolling of the hot-rolled steel sheet, cold-rolled sheet annealing, and subsequent cooling, this steel sheet does not include a surface coarse grain layer.

Incidentally, the steel sheet or the high-strength steel sheet may be immersed in a plating bath to form a plating layer, and alloying treatment at 600° C. or less may be performed after forming the plating layer. For example, a hot-dip galvanized layer may be formed, and then an alloying treatment may be carried out. An over-plating layer may be formed on the hot-dip galvanizing layer. After forming the hot-dip galvanized layer, surface treatment such as chromate treatment, phosphate treatment, lubricity improving treatment and weldability improving treatment may be carried out. Pickling and skin-pass rolling may be carried out.

The area fraction of each phase and structure may be measured by the following method, for example. For example, Le Pera etching or Nital etching of a high-strength steel sheet is performed, observation using an optical microscope or a scanning electron microscope (SEM) is performed, each phase and structure are identified, and the area fractions are measured using an image analyzer or the like. The observation target region is, for example, a region whose depth from the surface of the high-strength steel sheet is ¼ of the thickness of the high-strength steel sheet. When measuring the average diameter and area of the martensite grains, measurements are made on 200 or more martensite grains.

The average diameter of the ferrite grains in the steel sheet used in the first example may be measured by the following method, for example. That is, Nital etching of the steel sheet is performed, a cross section orthogonal to the rolling direction is observed using an optical microscope or SEM, and the average diameter of ferrite grains is measured using an image analyzer or the like. The observation target area is a region whose depth from the surface of the steel sheet is ¼ of the thickness of the steel sheet and a surface layer portion. These measurement methods are merely examples, and measurement methods are not limited to these methods.

The area fraction of unrecrystallized ferrite in the steel sheet used in the second example may be measured by the following method, for example. That is, a specimen is prepared in which a region whose depth from the surface of the steel sheet is ¼ of the thickness of the steel sheet is a measurement plane, and the crystal orientation measurement data is obtained in electron back scattering pattern (EBSP) of each of the measurement planes. In the preparation of the sample, for example, thinning by mechanical polishing or the like and removal of strain and thinning by electrolytic polishing or the like are performed. EBSP measures 5 points or more in each grain of the sample and the crystal orientation measurement data are obtained from each measurement result for each measurement point (pixel). Then, the obtained crystal orientation measurement data is analyzed by the Kernel Average Misorientation (KAM) method to distinguish the unrecrystallized ferrite contained in the ferrite, and the area fraction of the unrecrystallized ferrite in the ferrite is calculated. From the area fraction of ferrite in the initial structure and the area fraction of unrecrystallized ferrite in ferrite, the area fraction of unrecrystallized ferrite in the initial structure can be calculated. In the KAM method, the misorientation between adjacent measuring points can be detected quantitatively. In the present invention, grains having an average misorientation of 1° or more from the adjacent measuring points are defined as unrecrystallized ferrite.

These measurement methods are merely examples, and measurement methods are not limited to these methods.

Note that the above-described embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

EXAMPLE

Next, examples of the present invention will be described. A condition of the examples is one condition example which is adopted in order to confirm a possibility of implementation and an effect of the present invention, and the present invention is not limited to this one condition example. The present invention allows an adoption of various conditions as long as an object of the present invention is achieved without departing from the gist of the present invention.

(First Experiment)

In a first experiment, steels having the components presented in Table 1 were melted and slabs were prepared by continuous casting by a conventional method. The balance of the chemical composition presented in Table 1 is Fe and impurities. An underline in Table 1 indicates that the value deviates from a range of the present invention. Then, hot rolling and cooling on ROT were performed under the conditions presented in Table 2 to obtain a steel sheet having an initial structure presented in Table 2. Thereafter, reheating was performed under the conditions presented in Table 2, and then pickling and skin-pass rolling with reduction ratio of 0.5% were performed to obtain a high-strength steel sheet. The thickness of the high-strength steel sheet was 2.6 mm to 3.2 mm. An underlines in Table 2 indicate that the item deviates from a range of the present invention. For the column of "surface coarse grain layer" in Table 2, those in which the average diameter $D_S$ of ferrite in the surface layer portion having a depth of $4\times D_0$ from the surface of the steel sheet is twice or less the average diameter $D_0$ "without", those that are more than twice as "with."

TABLE 1

| STEEL | CHEMICAL COMPOSITION (MASS %) | | | | | | | | | | | | | | Ar3 POINT |
|---|---|---|---|---|---|---|---|---|---|---|---|---|---|---|---|
| SYMBOL | C | Si | Mn | P | S | N | Al | Nb | Ti | Ca | Mg | Zr | REM | OTHERS | (° C.) |
| A | 0.060 | 0.01 | 1.2 | 0.008 | 0.0020 | 0.003 | 0.30 | 0.01 | 0.05 | — | — | — | — | — | 807 |
| B | 0.320 | 0.01 | 3.7 | 0.010 | 0.0018 | 0.004 | 1.80 | — | — | — | — | — | — | — | 597 |

TABLE 1-continued

| STEEL | CHEMICAL COMPOSITION (MASS %) | | | | | | | | | | | | | | Ar3 POINT |
|---|---|---|---|---|---|---|---|---|---|---|---|---|---|---|---|
| SYMBOL | C | Si | Mn | P | S | N | Al | Nb | Ti | Ca | Mg | Zr | REM | OTHERS | (° C.) |
| C | 0.061 | 0.88 | 1.2 | 0.018 | 0.0030 | 0.004 | 0.04 | — | — | 0.0023 | — | — | — | — | 817 |
| D | 0.090 | 0.01 | 1.6 | 0.008 | 0.0030 | 0.004 | 0.40 | — | — | 0.0030 | — | — | — | — | 772 |
| E | 0.120 | 0.02 | 1.6 | 0.009 | 0.0010 | 0.004 | 0.40 | — | — | 0.0027 | — | — | 0.0070 | — | 757 |
| F | 0.090 | 1.54 | 1.5 | 0.011 | 0.0010 | 0.004 | 0.03 | 0.16 | — | — | — | — | — | Cu: 1.15, Ni: 0.58 | 800 |
| G | 0.090 | 1.50 | 2.0 | 0.008 | 0.0010 | 0.002 | 0.04 | 0.04 | 0.13 | — | — | — | — | B: 0.002 | 767 |
| H | 0.080 | 1.50 | 2.0 | 0.009 | 0.0010 | 0.004 | 0.50 | — | — | 0.0027 | — | — | — | — | 797 |
| I | 0.150 | 1.90 | 2.0 | 0.020 | 0.0400 | 0.003 | 0.30 | — | — | — | — | — | — | — | 764 |
| J | 0.055 | 0.50 | 2.0 | 0.008 | 0.0030 | 0.008 | 0.03 | 0.05 | 0.18 | — | 0.0030 | — | — | — | 758 |
| K | 0.050 | 0.80 | 0.8 | 0.060 | 0.0020 | 0.002 | 0.04 | 0.02 | 0.03 | — | — | — | — | Cu: 0.25, Ni: 0.18 | 857 |
| L | 0.070 | 0.01 | 1.2 | 0.008 | 0.0030 | 0.004 | 0.60 | 0.04 | 0.17 | 0.0023 | — | — | — | | 818 |
| M | 0.061 | 0.88 | 1.2 | 0.018 | 0.0030 | 0.004 | 0.04 | — | — | 0.0023 | — | — | — | Mo: 0.1 | 817 |
| N | 0.080 | 1.50 | 2.0 | 0.009 | 0.0010 | 0.004 | 0.50 | — | — | 0.0027 | — | — | — | | 797 |
| O | 0.050 | 0.50 | 1.6 | 0.009 | 0.0030 | 0.002 | 0.03 | — | 0.05 | — | — | 0.0050 | — | V: 0.05, B: 0.0005 | 786 |
| P | 0.090 | 0.01 | 2.0 | 0.011 | 0.0020 | 0.002 | 0.80 | 0.04 | 0.18 | — | — | — | 0.0050 | Cr: 2.5 | 769 |
| Q | 0.180 | 1.00 | 2.0 | 0.060 | 0.0020 | 0.002 | 0.03 | — | — | — | — | — | 0.0050 | — | 719 |
| a | 0.380 | 1.20 | 1.4 | 0.020 | 0.0030 | 0.003 | 0.01 | — | 0.12 | — | — | — | — | — | 651 |
| b | 0.070 | 0.10 | 4.2 | 0.130 | 0.0025 | 0.003 | 0.03 | — | — | — | — | — | — | — | 628 |
| c | 0.050 | 1.00 | 1.0 | 0.020 | 0.0030 | 0.003 | 0.04 | 0.40 | — | — | — | — | — | — | 840 |
| d | 0.020 | 1.00 | 3.0 | 0.010 | 0.0040 | 0.002 | 0.03 | 0.03 | 0.10 | — | — | — | — | — | 726 |
| e | 0.070 | 1.50 | 1.4 | 0.010 | 0.0700 | 0.003 | 0.03 | — | 0.04 | — | — | — | — | — | 815 |
| f | 0.060 | 0.10 | 1.1 | 0.008 | 0.0020 | 0.015 | 0.03 | — | 0.40 | — | — | — | — | — | 806 |
| g | 0.070 | 1.00 | 2.0 | 0.008 | 0.0020 | 0.001 | 0.03 | — | — | 0.020 | — | — | — | — | 764 |
| h | 0.075 | 1.00 | 1.2 | 0.018 | 0.0030 | 0.004 | 0.04 | — | 0.03 | — | 0.0030 | — | — | — | 815 |
| i | 0.070 | 1.00 | 1.2 | 0.018 | 0.0030 | 0.004 | 0.04 | — | 0.05 | — | 0.0020 | — | — | — | 817 |

TABLE 2

| SAMPLE No. | STEEL SYMBOL | HOT ROLLING (LAST TWO STANDS) TEMPERATURE OF SECOND TO LAST STAND (° C.) | HOT ROLLING (LAST TWO STANDS) TEMPERATURE OF LAST STAND (° C.) | HOT ROLLING (LAST TWO STANDS) REDUCTION RATIO (%) | COOLING STOP TEMPERATURE (° C.) | INITIAL STRUCTURE AREA FRACTION OF PEARLITE (%) | INITIAL STRUCTURE AVERAGE DIAMETER OF PEARLITE (μm) | SURFACE COARSE GRAIN LAYER | REHEATING AVERAGE HEATING RATE (° C./s) | REHEATING ACHEVED TEMPERATURE (° C.) | REHEATING HOLDING TIME (s) | REHEATING AVERAGE COOLING RATE (° C./s) | REHEATING COOLING STOP TEMPERATURE (° C.) | PLATING | REMARKS |
|---|---|---|---|---|---|---|---|---|---|---|---|---|---|---|---|
| 1 | A | 898 | 880 | 25 | 600 | 21 | 19.3 | WITHOUT | 30 | 800 | 2 | 100 | 40 | WITH | COMPARATIVE EXAMPLE |
| 2 | A | 898 | 880 | 25 | 500 | 5 | 2.9 | WITHOUT | 30 | 800 | 2 | 70 | 40 | WITH | INVENTION EXAMPLE |
| 3 | A | 898 | 880 | 25 | 500 | 5 | 2.9 | WITHOUT | 100 | 800 | 2 | 100 | 40 | WITHOUT | INVENTION EXAMPLE |
| 4 | B | 877 | 860 | 20 | 480 | 6 | 5.2 | WITHOUT | 2 | 800 | 2 | 100 | 40 | WITHOUT | COMPARATIVE EXAMPLE |
| 5 | B | 877 | 860 | 20 | 480 | 6 | 5.2 | WITHOUT | 30 | 800 | 0 | 70 | 40 | WITH | INVENTION EXAMPLE |
| 6 | B | 874 | 860 | 12 | 480 | 6 | 12.0 | WITHOUT | 30 | 800 | 2 | 70 | 40 | WITHOUT | COMPARATIVE EXAMPLE |
| 7 | C | 818 | 800 | 25 | 300 | 3 | 1.8 | WITH | 30 | 740 | 2 | 100 | 40 | WITH | COMPARATIVE EXAMPLE |
| 8 | C | 918 | 900 | 25 | 300 | 3 | 2.1 | WITHOUT | 100 | 780 | 2 | 100 | 40 | WITH | INVENTION EXAMPLE |
| 9 | C | 918 | 900 | 25 | 300 | 3 | 2.1 | WITHOUT | 30 | 780 | 2 | 70 | 200 | WITHOUT | INVENTION EXAMPLE |
| 10 | D | 917 | 900 | 20 | 40 | 0 | — | WITHOUT | 30 | 800 | 9 | 70 | 40 | WITH | COMPARATIVE EXAMPLE |
| 11 | D | 917 | 900 | 20 | 40 | 0 | — | WITHOUT | 30 | 800 | 2 | 70 | 40 | WITH | INVENTION EXAMPLE |
| 12 | D | 917 | 900 | 20 | 40 | 0 | — | WITHOUT | 10 | 800 | 2 | 100 | 40 | WITH | INVENTION EXAMPLE |
| 13 | E | 898 | 880 | 25 | 500 | 5 | 3.0 | WITHOUT | 100 | 700 | 1 | 100 | 40 | WITHOUT | COMPARATIVE EXAMPLE |
| 14 | E | 898 | 880 | 25 | 500 | 5 | 3.0 | WITHOUT | 100 | 780 | 1 | 100 | 40 | WITH | INVENTION EXAMPLE |
| 15 | E | 898 | 880 | 25 | 500 | 5 | 3.0 | WITHOUT | 100 | 780 | 0 | 100 | 600 | WITH | COMPARATIVE EXAMPLE |
| 16 | F | 918 | 900 | 25 | 400 | 4 | 2.6 | WITHOUT | 100 | 780 | 2 | 100 | 40 | WITH | INVENTION EXAMPLE |
| 17 | F | 918 | 900 | 25 | 400 | 4 | 2.6 | WITHOUT | 30 | 780 | 8 | 70 | 40 | WITHOUT | INVENTION EXAMPLE |
| 18 | G | 918 | 900 | 25 | 500 | 5 | 3.0 | WITHOUT | 30 | 780 | 1 | 70 | 40 | WITH | INVENTION EXAMPLE |
| 19 | G | 918 | 900 | 25 | 500 | 5 | 3.0 | WITHOUT | 100 | 780 | 2 | 100 | 40 | WITH | INVENTION EXAMPLE |

TABLE 2-continued

| SAMPLE No. | STEEL SYMBOL | HOT ROLLING (LAST TWO STANDS) TEMPERATURE OF SECOND TO LAST STAND (° C.) | HOT ROLLING (LAST TWO STANDS) TEMPERATURE OF LAST STAND (° C.) | REDUCTION RATIO (%) | COOLING STOP TEMPERATURE (° C.) | INITIAL STRUCTURE AREA FRACTION OF PEARLITE (%) | INITIAL STRUCTURE AVERAGE DIAMETER OF PEARLITE (μm) | SURFACE COARSE GRAIN LAYER | REHEATING AVERAGE HEATING RATE (° C./s) | REHEATING ACHEVED TEMPERATURE (° C.) | REHEATING HOLDING TIME (s) | REHEATING AVERAGE COOLING RATE (° C./s) | REHEATING COOLING STOP TEMPERATURE (° C.) | PLATING | REMARKS |
|---|---|---|---|---|---|---|---|---|---|---|---|---|---|---|---|
| 20 | G | 918 | 900 | 25 | 500 | 5 | 3.0 | WITHOUT | 50 | 780 | 4 | 50 | 40 | WITHOUT | COMPARATIVE EXAMPLE |
| 21 | H | 888 | 870 | 25 | 500 | 5 | 2.9 | WITHOUT | 100 | 780 | 2 | 100 | 40 | WITH | INVENTION EXAMPLE |
| 22 | I | 918 | 900 | 25 | 500 | 5 | 3.1 | WITHOUT | 100 | 800 | 2 | 100 | 40 | WITH | INVENTION EXAMPLE |
| 23 | J | 918 | 900 | 25 | 500 | 5 | 2.9 | WITHOUT | 30 | 780 | 2 | 70 | 40 | WITH | INVENTION EXAMPLE |
| 24 | K | 940 | 920 | 30 | 450 | 4 | 0.8 | WITHOUT | 30 | 780 | 2 | 70 | 40 | WITH | INVENTION EXAMPLE |
| 25 | K | 940 | 920 | 30 | 450 | 4 | 0.8 | WITHOUT | 100 | 800 | 2 | 100 | 320 | WITH | COMPARATIVE EXAMPLE |
| 26 | K | 885 | 885 | 30 | 450 | 4 | 0.6 | WITH | 30 | 780 | 2 | 70 | 40 | WITH | COMPARATIVE EXAMPLE |
| 27 | L | 918 | 900 | 25 | 40 | 0 | — | WITHOUT | 30 | 780 | 2 | 70 | 40 | WITH | INVENTION EXAMPLE |
| 28 | L | 918 | 900 | 25 | 40 | 0 | — | WITHOUT | 30 | 780 | 2 | 70 | 40 | WITHOUT | INVENTION EXAMPLE |
| 29 | M | 910 | 890 | 30 | 40 | 0 | — | WITHOUT | 100 | 780 | 2 | 100 | 40 | WITHOUT | INVENTION EXAMPLE |
| 30 | M | 910 | 890 | 30 | 40 | 0 | — | WITHOUT | 30 | 780 | 2 | 70 | 40 | WITH | INVENTION EXAMPLE |
| 31 | N | 918 | 900 | 25 | 150 | 1 | 1.6 | WITHOUT | 6 | 780 | 2 | 100 | 40 | WITHOUT | INVENTION EXAMPLE |
| 32 | N | 918 | 900 | 25 | 150 | 1 | 1.6 | WITHOUT | 30 | 780 | 2 | 100 | 40 | WITHOUT | INVENTION EXAMPLE |
| 33 | N | 918 | 900 | 25 | 150 | 1 | 1.6 | WITHOUT | 100 | 780 | 2 | 100 | 40 | WITHOUT | INVENTION EXAMPLE |
| 34 | O | 887 | 870 | 20 | 380 | 4 | 4.3 | WITHOUT | 30 | 750 | 1 | 70 | 40 | WITH | COMPARATIVE EXAMPLE |
| 35 | O | 887 | 870 | 20 | 380 | 4 | 4.3 | WITHOUT | 30 | 770 | 1 | 70 | 40 | WITH | INVENTION EXAMPLE |
| 36 | P | 918 | 900 | 25 | 500 | 5 | 3.0 | WITHOUT | 30 | 770 | 1 | 100 | 40 | WITHOUT | INVENTION EXAMPLE |
| 37 | Q | 897 | 880 | 20 | 500 | 5 | 5.1 | WITHOUT | 30 | 780 | 2 | 100 | 40 | WITHOUT | INVENTION EXAMPLE |
| 38 | a | 898 | 880 | 25 | 40 | 12 | 15.0 | WITHOUT | 30 | 780 | 2 | 70 | 40 | WITH | COMPARATIVE EXAMPLE |
| 39 | b | 898 | 880 | 25 | 40 | 0 | 1.0 | WITHOUT | 30 | 780 | 2 | 70 | 40 | WITH | COMPARATIVE EXAMPLE |

TABLE 2-continued

| SAMPLE No. | STEEL SYMBOL | HOT ROLLING (LAST TWO STANDS) TEMPERATURE OF SECOND TO LAST STAND (° C.) | HOT ROLLING (LAST TWO STANDS) TEMPERATURE OF LAST STAND (° C.) | REDUCTION RATIO (%) | COOLING STOP TEMPERATURE (° C.) | INITIAL STRUCTURE AREA FRACTION OF PEARLITE (%) | INITIAL STRUCTURE AVERAGE DIAMETER OF PEARLITE (μm) | SURFACE COARSE GRAIN LAYER | REHEATING AVERAGE HEATING RATE (° C./s) | REHEATING ACHEVED TEMPERATURE (° C.) | REHEATING HOLDING TIME (s) | REHEATING AVERAGE COOLING RATE (° C./s) | REHEATING COOLING STOP TEMPERATURE (° C.) | PLATING | REMARKS |
|---|---|---|---|---|---|---|---|---|---|---|---|---|---|---|---|
| 40 | c | 898 | 880 | 25 | 40 | 0 | 1.0 | WITHOUT | 30 | 780 | 2 | 70 | 40 | WITH | COMPARATIVE EXAMPLE |
| 41 | d | 898 | 880 | 25 | 40 | 0 | 0.9 | WITHOUT | 30 | 780 | 2 | 70 | 40 | WITH | COMPARATIVE EXAMPLE |
| 42 | e | 898 | 880 | 25 | 40 | 0 | 1.0 | WITHOUT | 30 | 780 | 2 | 70 | 40 | WITH | COMPARATIVE EXAMPLE |
| 43 | f | 898 | 880 | 25 | 40 | 0 | 1.0 | WITHOUT | 30 | 780 | 2 | 70 | 40 | WITHOUT | COMPARATIVE EXAMPLE |
| 44 | g | 898 | 880 | 25 | 40 | 0 | 1.0 | WITHOUT | 30 | 780 | 2 | 70 | 40 | WITHOUT | COMPARATIVE EXAMPLE |
| 45 | h | 898 | 880 | 25 | 250 | 2 | 1.9 | WITHOUT | 150 | 760 | 1 | 100 | 450 | WITHOUT | COMPARATIVE EXAMPLE |
| 46 | i | 938 | 920 | 25 | 20 | 0 | 1.1 | WITHOUT | 200 | 780 | 1 | 100 | 450 | WITHOUT | COMPARATIVE EXAMPLE |
| 47 | C | 918 | 900 | 25 | 300 | 3 | 2.1 | WITHOUT | 50 | 780 | 0 | 50 | 450 | WITHOUT | COMPARATIVE EXAMPLE |
| 48 | C | 918 | 900 | 25 | 300 | 3 | 2.1 | WITHOUT | 100 | 800 | 0 | 100 | 550 | WITHOUT | COMPARATIVE EXAMPLE |
| 49 | C | 893 | 870 | 40 | 700 | 12 | 1.2 | WITHOUT | 60 | 800 | 7 | 150 | 270 | WITHOUT | COMPARATIVE EXAMPLE |
| 50 | C | 918 | 900 | 25 | 300 | 3 | 2.1 | WITHOUT | 130 | 800 | 7 | 150 | 270 | WITHOUT | COMPARATIVE EXAMPLE |
| 51 | C | 918 | 900 | 25 | 300 | 3 | 2.1 | WITHOUT | 60 | 830 | 7 | 150 | 270 | WITHOUT | COMPARATIVE EXAMPLE |
| 52 | C | 918 | 900 | 25 | 300 | 3 | 2.1 | WITHOUT | 60 | 770 | 0 | 150 | 270 | WITHOUT | INVENTION EXAMPLE |

For each of the high-strength steel sheets, the microstructure was identified and configuration of martensite was identified. These results are presented in Table 3. An underlines in Table 3 indicates that the item deviates from a range of the present invention.

TABLE 3

| SAMPLE No. | STEEL SYMBOL | MICROSTRUCTURE (AREA %) MARTENSITE | FERRITE | PEARLITE | SURFACE COARSE GRAIN LAYER | CONFIGURATION OF MARTENSITE AVERAGE DIAMETER (μm) | RATIO OF BULGING TYPE (%) | AREA RATIO | REMARKS |
|---|---|---|---|---|---|---|---|---|---|
| 1 | A | 4 | 70 | 10 | WITHOUT | 1.3 | 89 | 1.24 | COMPARATIVE EXAMPLE |
| 2 | A | 11 | 77 | 1 | WITHOUT | 1.6 | 88 | 1.22 | INVENTION EXAMPLE |
| 3 | A | 15 | 70 | 1 | WITHOUT | 1.4 | 88 | 1.24 | INVENTION EXAMPLE |
| 4 | B | 23 | 58 | 1 | WITHOUT | 7.7 | 87 | 1.16 | COMPARATIVE EXAMPLE |
| 5 | B | 26 | 55 | 1 | WITHOUT | 2.2 | 86 | 1.18 | INVENTION EXAMPLE |
| 6 | B | 19 | 55 | 9 | WITHOUT | 5.7 | 87 | 1.17 | COMPARATIVE EXAMPLE |
| 7 | C | 7 | 80 | 0 | WITH | 1.7 | 82 | 1.14 | COMPARATIVE EXAMPLE |
| 8 | C | 14 | 71 | 1 | WITHOUT | 1.3 | 86 | 1.21 | INVENTION EXAMPLE |
| 9 | C | 10 | 78 | 1 | WITHOUT | 1.6 | 86 | 1.20 | INVENTION EXAMPLE |
| 10 | D | 12 | 77 | 0 | WITHOUT | 6.3 | 37 | 1.28 | COMPARATIVE EXAMPLE |
| 11 | D | 12 | 77 | 0 | WITHOUT | 1.7 | 88 | 1.22 | INVENTION EXAMPLE |
| 12 | D | 9 | 79 | 0 | WITHOUT | 2.6 | 88 | 1.19 | INVENTION EXAMPLE |
| 13 | E | 3 | 73 | 9 | WITHOUT | 0.9 | 5 | 0.47 | COMPARATIVE EXAMPLE |
| 14 | E | 31 | 47 | 1 | WITHOUT | 1.8 | 85 | 1.18 | INVENTION EXAMPLE |
| 15 | E | 17 | 47 | 15 | WITHOUT | 1.3 | 85 | 1.19 | COMPARATIVE EXAMPLE |
| 16 | F | 36 | 41 | 1 | WITHOUT | 1.9 | 84 | 1.16 | INVENTION EXAMPLE |
| 17 | F | 32 | 48 | 1 | WITHOUT | 3.1 | 75 | 1.21 | INVENTION EXAMPLE |
| 18 | G | 47 | 28 | 1 | WITHOUT | 3.0 | 85 | 1.15 | INVENTION EXAMPLE |
| 19 | G | 51 | 21 | 1 | WITHOUT | 2.5 | 86 | 1.17 | INVENTION EXAMPLE |
| 20 | G | 4 | 26 | 20 | WITHOUT | 1.1 | 89 | 1.26 | COMPARATIVE EXAMPLE |
| 21 | H | 30 | 49 | 1 | WITHOUT | 2.0 | 84 | 1.16 | INVENTION EXAMPLE |
| 22 | I | 31 | 47 | 1 | WITHOUT | 2.0 | 88 | 1.21 | INVENTION EXAMPLE |
| 23 | J | 43 | 33 | 1 | WITHOUT | 2.9 | 84 | 1.14 | INVENTION EXAMPLE |
| 24 | K | 11 | 77 | 0 | WITHOUT | 1.6 | 86 | 1.20 | INVENTION EXAMPLE |
| 25 | K | 2 | 69 | 0 | WITHOUT | 0.8 | 89 | 1.29 | COMPARATIVE EXAMPLE |
| 26 | K | 11 | 77 | 0 | WITH | 1.7 | 86 | 1.19 | COMPARATIVE EXAMPLE |
| 27 | L | 37 | 43 | 0 | WITHOUT | 2.6 | 86 | 1.17 | INVENTION EXAMPLE |
| 28 | L | 37 | 43 | 0 | WITHOUT | 2.6 | 86 | 1.17 | INVENTION EXAMPLE |
| 29 | M | 15 | 70 | 0 | WITHOUT | 1.4 | 86 | 1.21 | INVENTION EXAMPLE |
| 30 | M | 12 | 77 | 0 | WITHOUT | 1.7 | 86 | 1.19 | INVENTION EXAMPLE |
| 31 | N | 24 | 57 | 0 | WITHOUT | 3.9 | 86 | 1.15 | INVENTION EXAMPLE |
| 32 | N | 26 | 55 | 0 | WITHOUT | 2.4 | 86 | 1.17 | INVENTION EXAMPLE |
| 33 | N | 31 | 48 | 0 | WITHOUT | 2.0 | 86 | 1.18 | INVENTION EXAMPLE |
| 34 | O | 4 | 92 | 1 | WITHOUT | 1.3 | 10 | 0.30 | COMPARATIVE EXAMPLE |
| 35 | O | 10 | 78 | 1 | WITHOUT | 1.5 | 84 | 1.18 | INVENTION EXAMPLE |
| 36 | P | 41 | 34 | 1 | WITHOUT | 2.7 | 81 | 1.11 | INVENTION EXAMPLE |
| 37 | Q | 50 | 22 | 1 | WITHOUT | 3.5 | 83 | 1.12 | INVENTION EXAMPLE |
| 38 | a | 44 | 18 | 12 | WITHOUT | 3.1 | 86 | 1.16 | COMPARATIVE EXAMPLE |
| 39 | b | 57 | 16 | 0 | WITHOUT | 3.8 | 86 | 1.15 | COMPARATIVE EXAMPLE |
| 40 | c | 41 | 37 | 0 | WITHOUT | 2.3 | 86 | 1.17 | COMPARATIVE EXAMPLE |
| 41 | d | 6 | 84 | 0 | WITHOUT | 1.3 | 87 | 1.21 | COMPARATIVE EXAMPLE |
| 42 | e | 14 | 73 | 0 | WITHOUT | 1.8 | 86 | 1.19 | COMPARATIVE EXAMPLE |
| 43 | f | 20 | 64 | 0 | WITHOUT | 1.8 | 86 | 1.19 | COMPARATIVE EXAMPLE |
| 44 | g | 29 | 53 | 0 | WITHOUT | 2.5 | 86 | 1.17 | COMPARATIVE EXAMPLE |
| 45 | h | 4 | 48 | 6 | WITHOUT | 0.9 | 50 | 0.81 | COMPARATIVE EXAMPLE |
| 46 | i | 4 | 38 | 6 | WITHOUT | 0.8 | 45 | 0.76 | COMPARATIVE EXAMPLE |
| 47 | C | 8 | 76 | 1 | WITHOUT | 1.1 | 45 | 0.72 | COMPARATIVE EXAMPLE |
| 48 | C | 12 | 70 | 1 | WITHOUT | 1.1 | 47 | 0.75 | COMPARATIVE EXAMPLE |
| 49 | C | 3 | 74 | 0 | WITHOUT | 1.5 | 58 | 0.87 | COMPARATIVE EXAMPLE |
| 50 | C | 3 | 67 | 1 | WITHOUT | 0.8 | 45 | 0.77 | COMPARATIVE EXAMPLE |
| 51 | C | 12 | 72 | 1 | WITHOUT | 4.8 | 42 | 0.62 | COMPARATIVE EXAMPLE |
| 52 | C | 9 | 75 | 1 | WITHOUT | 1.1 | 70 | 1.03 | INVENTION EXAMPLE |

Further, a tensile test was conducted on each of the high-strength steel sheets according to JIS Z 2241, and the tensile strength TS, the elongation EL, and the reduction of area RA were measured. The broken part were observed with enlarging by an epidioscope, the average W of the widths on both sides and the average t of the thicknesses on both sides at the broken part are measured, and the reduction of area RA was calculated from the following Expression 1. Here, W0 and t0 denotes the width and the thickness before the tensile test, respectively. These results are presented in Table 4. An underline in Table 4 indicates that the value deviates from a desirable range.

$$RA=1-(W\times t)/(W0\times t0) \quad \text{(Expression 1)}$$

TABLE 4

| SAMPLE No. | STEEL SYMBOL | MECHANICAL PROPERTIES TENSILE STRENGTH TS (N/mm$^2$) | ELONGATION EL (%) | TS × EL (N/mm$^2$ %) | REDUCTION OF AREA RA | REMARKS |
|---|---|---|---|---|---|---|
| 1 | A | 561 | 25.2 | 14149 | 0.28 | COMPARATIVE EXAMPLE |
| 2 | A | 598 | 32.9 | 19681 | 0.60 | INVENTION EXAMPLE |
| 3 | A | 616 | 32.0 | 19693 | 0.59 | INVENTION EXAMPLE |
| 4 | B | 788 | 14.9 | 17788 | 0.30 | COMPARATIVE EXAMPLE |
| 5 | B | 806 | 23.8 | 19187 | 0.55 | INVENTION EXAMPLE |
| 6 | B | 767 | 15.2 | 11665 | 0.24 | COMPARATIVE EXAMPLE |
| 7 | C | 578 | 28.8 | 16633 | 0.34 | COMPARATIVE EXAMPLE |
| 8 | C | 611 | 32.5 | 19881 | 0.59 | INVENTION EXAMPLE |
| 9 | C | 593 | 33.5 | 19869 | 0.60 | INVENTION EXAMPLE |
| 10 | D | 600 | 25.0 | 15010 | 0.37 | COMPARATIVE EXAMPLE |
| 11 | D | 600 | 33.0 | 19793 | 0.60 | INVENTION EXAMPLE |
| 12 | D | 585 | 33.9 | 19856 | 0.61 | INVENTION EXAMPLE |
| 13 | E | 704 | 25.0 | 17590 | 0.11 | COMPARATIVE EXAMPLE |
| 14 | E | 844 | 23.9 | 20198 | 0.54 | INVENTION EXAMPLE |
| 15 | E | 773 | 22.0 | 17010 | 0.18 | COMPARATIVE EXAMPLE |
| 16 | F | 853 | 22.2 | 18952 | 0.52 | INVENTION EXAMPLE |
| 17 | F | 835 | 22.1 | 18446 | 0.55 | INVENTION EXAMPLE |
| 18 | G | 999 | 20.0 | 19971 | 0.50 | INVENTION EXAMPLE |
| 19 | G | 1018 | 19.6 | 19963 | 0.49 | INVENTION EXAMPLE |
| 20 | G | 783 | 12.0 | 9393 | 0.18 | COMPARATIVE EXAMPLE |
| 21 | H | 837 | 22.9 | 19199 | 0.54 | INVENTION EXAMPLE |
| 22 | I | 838 | 22.7 | 19017 | 0.54 | INVENTION EXAMPLE |
| 23 | J | 945 | 20.0 | 18924 | 0.50 | INVENTION EXAMPLE |
| 24 | K | 605 | 31.2 | 18873 | 0.60 | INVENTION EXAMPLE |
| 25 | K | 559 | 25.0 | 13973 | 0.38 | COMPARATIVE EXAMPLE |
| 26 | K | 611 | 26.0 | 15885 | 0.35 | COMPARATIVE EXAMPLE |
| 27 | L | 1020 | 19.4 | 19833 | 0.53 | INVENTION EXAMPLE |
| 28 | L | 1017 | 19.5 | 19833 | 0.53 | INVENTION EXAMPLE |
| 29 | M | 628 | 29.4 | 18501 | 0.59 | INVENTION EXAMPLE |
| 30 | M | 610 | 30.3 | 18491 | 0.60 | INVENTION EXAMPLE |
| 31 | N | 807 | 24.8 | 20035 | 0.56 | INVENTION EXAMPLE |
| 32 | N | 816 | 24.4 | 19899 | 0.56 | INVENTION EXAMPLE |
| 33 | N | 842 | 23.6 | 19912 | 0.54 | INVENTION EXAMPLE |
| 34 | O | 568 | 27.0 | 15328 | 0.17 | COMPARATIVE EXAMPLE |
| 35 | O | 597 | 31.4 | 18753 | 0.59 | INVENTION EXAMPLE |
| 36 | P | 931 | 21.3 | 19869 | 0.50 | INVENTION EXAMPLE |
| 37 | Q | 929 | 22.0 | 20441 | 0.48 | INVENTION EXAMPLE |
| 38 | a | 710 | 15.0 | 10643 | 0.10 | COMPARATIVE EXAMPLE |
| 39 | b | 1114 | 8.0 | 8908 | 0.12 | COMPARATIVE EXAMPLE |
| 40 | c | 937 | 10.0 | 9367 | 0.15 | COMPARATIVE EXAMPLE |
| 41 | d | 459 | 30.0 | 13774 | 0.40 | COMPARATIVE EXAMPLE |
| 42 | e | 631 | 16.0 | 10096 | 0.10 | COMPARATIVE EXAMPLE |
| 43 | f | 704 | 14.0 | 9859 | 0.15 | COMPARATIVE EXAMPLE |
| 44 | g | 802 | 12.0 | 9623 | 0.12 | COMPARATIVE EXAMPLE |
| 45 | h | 610 | 31.2 | 19032 | 0.45 | COMPARATIVE EXAMPLE |
| 46 | i | 732 | 27.6 | 20203 | 0.44 | COMPARATIVE EXAMPLE |
| 47 | C | 570 | 29.7 | 16928 | 0.25 | COMPARATIVE EXAMPLE |
| 48 | C | 620 | 27.5 | 17038 | 0.25 | COMPARATIVE EXAMPLE |
| 49 | C | 558 | 29.0 | 16170 | 0.30 | COMPARATIVE EXAMPLE |
| 50 | C | 535 | 30.8 | 16477 | 0.27 | COMPARATIVE EXAMPLE |
| 51 | C | 627 | 27.5 | 17246 | 0.23 | COMPARATIVE EXAMPLE |
| 52 | C | 588 | 31.0 | 18228 | 0.52 | INVENTION EXAMPLE |

As presented in Table 4, as for the sample No. 2-No. 3, No. 5, No. 8-No. 9, No. 11-No. 12, No. 14, No. 16-No. 19, No. 21-No. 24, No. 27-No. 33, No. 35-No. 37, and No. 52 within the scope of the present invention, excellent tensile strength and reduction of area RA were obtained, and the balance between the tensile strength and the elongation was also good.

On the other hand, as for sample No. 1, the area fraction of pearlite was too high and the average diameter of the pearlite grains was too large in the steel sheet, the area fraction of martensite was too low and the area fraction of pearlite was too high in the high-strength steel sheet. For this reason, good product (TS×EL) and reduction of area RA could not be obtained. The reason why the area fraction of pearlite in the steel sheet was too high and the average diameter of the pearlite grains was too large is that the cooling stop temperature after hot rolling was too high.

As for sample No. 4, the average diameter of martensite in the high-strength steel sheet was too large because the average cooling rate of reheating was too low. For this reason, good product (TS×EL) and reduction of area RA could not be obtained.

As for sample No. 6, the pearlite area fraction in the high-strength steel sheet was too high because the average diameter of the pearlite grains in the steel sheet was too large. For this reason, good product (TS×EL) and reduction of area RA could not be obtained. The reason why the average diameter of the pearlite grains in the steel sheet was too large is that the total reduction ratio in the last two stands of hot rolling was too low.

As for sample No. 7, since the surface coarse grain layer was contained in the steel sheet, the surface coarse grain layer remained also in the high-strength steel sheet. For this reason, good product (TS×EL) and reduction of area RA could not be obtained. The reason why the surface coarse grain layer was included in the steel sheet is that the temperature of the last two stands of hot rolling was too low.

As for sample No. 10, the holding time of reheating was too long, so that the average diameter of martensite was too large and the ratio of bulging type martensite grains was too low in the high-strength steel sheet. For this reason, good product (TS×EL) and reduction of area RA could not be obtained.

As for sample No. 13, the achieved temperature of reheating was too low, the area fraction of martensite was too low, the area fraction of pearlite was too high, and the ratio of bulging type martensite grains was too low in the high-strength steel sheet. For this reason, good product (TS×EL) and reduction of area RA could not be obtained.

As for sample No. 15, the area fraction of pearlite in the high-strength steel sheet was too high because the cooling stop temperature of reheating was too high. For this reason, good product (TS×EL) and reduction of area RA could not be obtained.

As for sample No. 20, the average cooling rate of reheating was too low, the area fraction of martensite was too low and the area fraction of pearlite was too high in the high-strength steel sheet. For this reason, good product (TS×EL) and reduction of area RA could not be obtained.

As for sample No. 25, the area fraction of martensite in the high-strength steel sheet was too low because the cooling stop temperature of reheating was too high. For this reason, good product (TS×EL) and reduction of area RA could not be obtained.

As for sample No. 26, since the surface coarse grain layer was contained in the steel sheet, the surface coarse grain layer remained also in the high-strength steel sheet. For this reason, good product (TS×EL) and reduction of area RA could not be obtained. The reason why the surface coarse grain layer was included in the steel sheet is that the temperature of the last two stands of hot rolling was too low.

As for sample No. 34, the achieved temperature of reheating was too low, so the area fraction of martensite was too low and the ratio of bulging type martensite grains was too low in the high-strength steel sheet. For this reason, good product (TS×EL) and reduction of area RA could not be obtained.

As for sample No. 38 to sample No. 44, since the chemical composition was out of the range of the present invention, good product (TS×EL) and reduction of area RA could not be obtained.

As for sample No. 45, since the average heating rate of reheating was too high, the achieved temperature was too low, and the cooling stop temperature was too high, the area fraction of martensite was too low, the area fraction of pearlite was too high, the ratio of bulging type martensite grains was too low, and the specific area ratio was too low in the high-strength steel sheet. For this reason, good reduction of area RA could not be obtained.

As for sample No. 46, since the average heating rate of reheating was too high and the cooling stopping temperature was too high, the area fraction of martensite was too low, the area fraction of pearlite was too high, and the ratio of bulging type martensite grains was too low, and the specific area ratio was too low in the high-strength steel sheet. For this reason, good reduction of area RA could not be obtained.

As for sample No. 47, since the average cooling rate of reheating was too low and the cooling stopping temperature was too high, many combined martensite grains were present, the ratio of bulging type martensite grains was too low, and the specific area ratio was too low in the high-strength steel sheet. For this reason, good product (TS×EL) and reduction of area RA could not be obtained.

As for sample No. 48, the cooling stop temperature was too high, so that the ratio of bulging type martensite grains was too low and the specific area ratio was too low. For this reason, good product (TS×EL) and reduction of area RA could not be obtained.

As for sample No. 49, since the area fraction of pearlite in the steel sheet was too high, the area fraction of martensite was too low, the ratio of bulging type martensite grains was too low, and the specific area ratio was too low in the high-strength steel sheet. For this reason, good product (TS×EL) and reduction of area RA could not be obtained. The reason why the area fraction of pearlite in the steel sheet was too high is that the cooling stop temperature after hot rolling was too high.

As for sample No. 50, since the average heating rate of reheating was too high, the area fraction of martensite was too low, the ratio of bulging type martensite grains was too low, and the specific area ratio was too low in the high-strength steel sheet. For this reason, good product (TS×EL) and reduction of area RA could not be obtained.

As for sample No. 51, since the achieved temperature of reheating was too high, the average diameter of martensite was too large, the ratio of bulging type martensite grains was too low, and the specific area ratio was too low in the high-strength steel sheet. For this reason, good product (TS×EL) and reduction of area RA could not be obtained.

Figure 7:
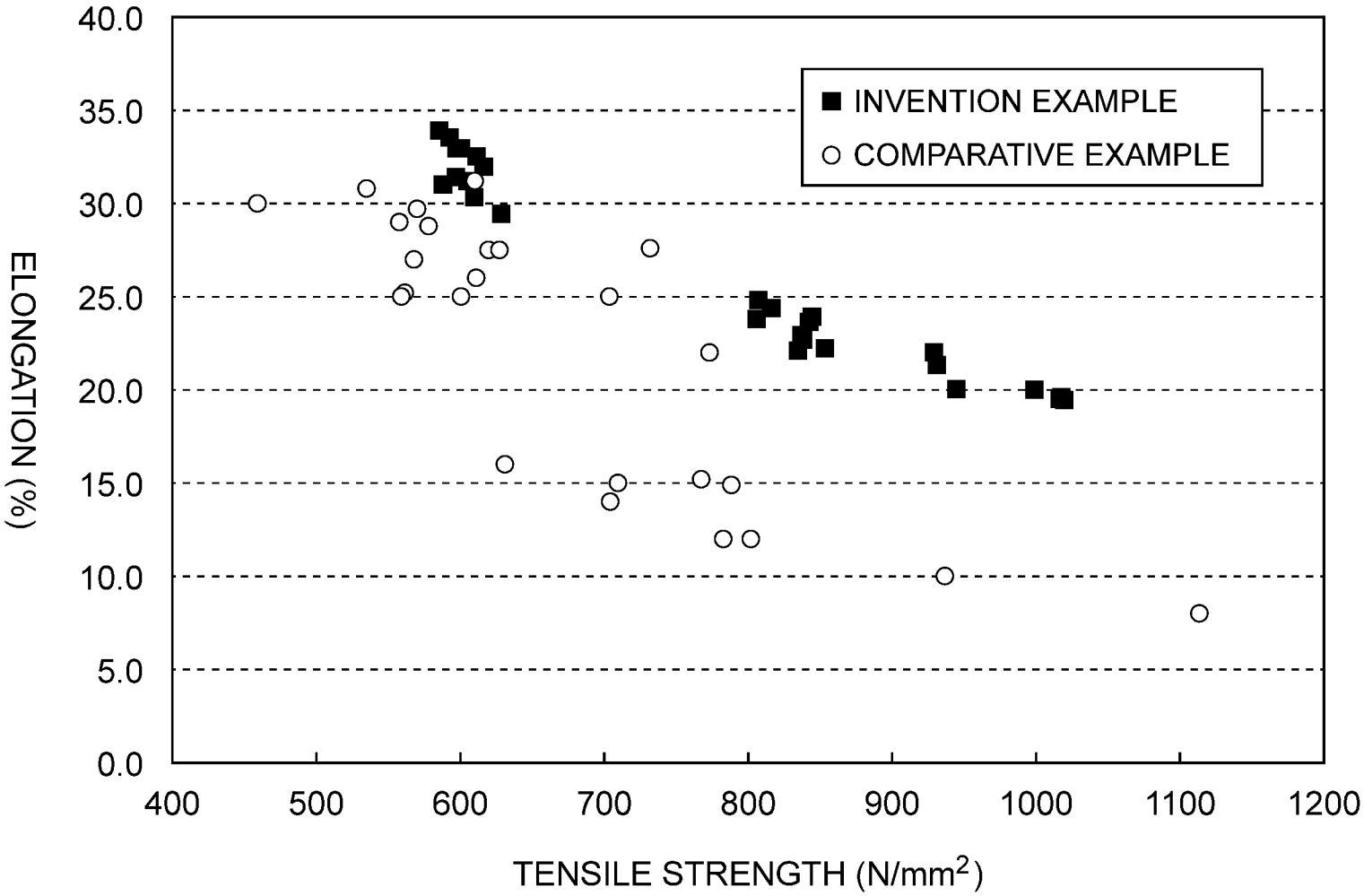
FIG. 7 is a diagram illustrating a relationship between tensile strength and elongation in a first experiment.
Figure 8:
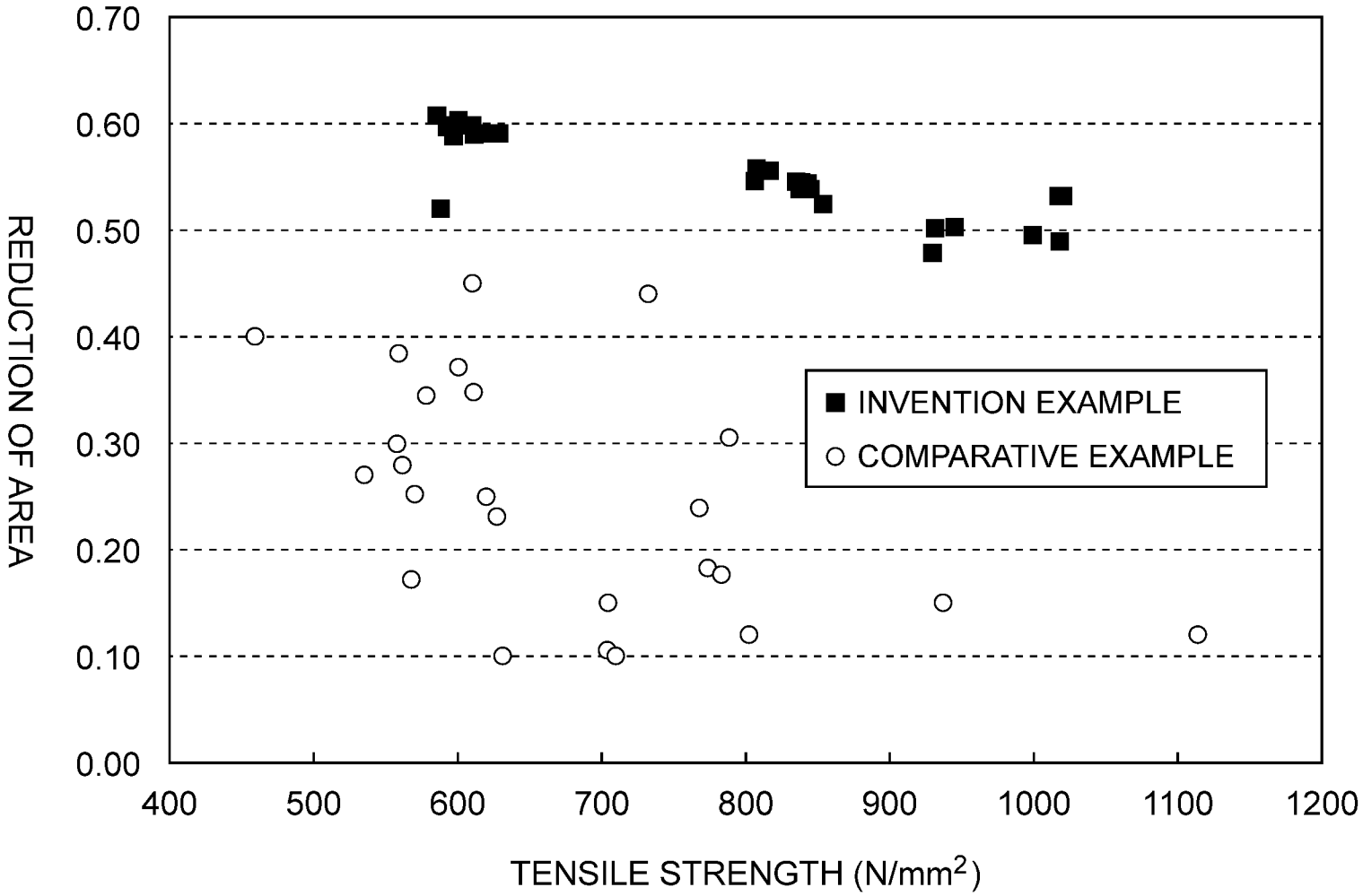
FIG. 8 is a diagram illustrating a relationship between the tensile strength and reduction of area in the first experiment.

FIG. 7 illustrates the relationship between the tensile strength and the elongation of the invention examples and comparative examples, and FIG. 8 illustrates the relationship between the tensile strength and the reduction of area. As illustrated in FIG. 7, if the tensile strength was substantially equal, the higher elongation could be obtained in the invention examples. As illustrated in FIG. 8, if the tensile strength was substantially equal, the excellent reduction of area could be obtained in the invention examples.

(Second Experiment)

In a second experiment, steels having the components presented in Table 5 were melted and slabs were prepared by continuous casting by a conventional method. The balance of the chemical composition presented in Table 5 is Fe and impurities. An underline in Table 5 indicates that the value deviates from a range of the present invention. Then, hot rolling was performed, and cold rolling, cold-rolled sheet annealing, and cooling were performed under the conditions presented in Table 6 to obtain a steel sheet having an initial structure presented in Table 6. Thereafter, reheating was performed under the conditions presented in Table 6, and pickling and skin-pass rolling with reduction ratio of 0.5% were performed to obtain a high-strength steel sheet. The thickness of the high-strength steel sheet was 1.0 mm to 1.8 mm. An underlines in Table 6 indicate that the item deviates from a range of the present invention.

TABLE 5

| STEEL | CHEMICAL COMPOSITION (MASS %) | | | | | | | | | | | | | | Ar3 POINT |
|---|---|---|---|---|---|---|---|---|---|---|---|---|---|---|---|
| SYMBOL | C | Si | Mn | P | S | N | Al | Nb | Ti | Ca | Mg | Zr | REM | OTHERS | (° C.) |
| AA | 0.080 | 0.10 | 2.0 | 0.020 | 0.0020 | 0.003 | 0.300 | 0.010 | 0.030 | — | — | — | — | — | 752 |
| BB | 0.090 | 0.60 | 2.1 | 0.015 | 0.0050 | 0.003 | 0.030 | 0.020 | 0.020 | — | — | — | — | — | 738 |
| CC | 0.080 | 0.55 | 1.8 | 0.018 | 0.0030 | 0.004 | 0.040 | — | — | 0.002 | — | — | — | Cr: 0.3 | 762 |
| DD | 0.090 | 0.01 | 1.6 | 0.008 | 0.0030 | 0.004 | 0.400 | — | — | 0.003 | — | — | — | — | 772 |
| EE | 0.090 | 0.60 | 2.1 | 0.009 | 0.0010 | 0.004 | 0.033 | 0.030 | — | — | — | — | — | — | 737 |
| FF | 0.090 | 1.54 | 1.5 | 0.011 | 0.0010 | 0.004 | 0.030 | 0.046 | — | — | — | — | — | Cu: 1.15, Ni: 0.58 | 800 |
| GG | 0.135 | 1.00 | 2.2 | 0.008 | 0.0010 | 0.002 | 0.036 | — | 0.040 | — | — | — | — | — | 718 |
| HH | 0.070 | 0.10 | 1.8 | 0.006 | 0.0030 | 0.003 | 0.040 | — | — | — | — | — | — | — | 752 |
| II | 0.190 | 0.50 | 2.8 | 0.060 | 0.0020 | 0.002 | 0.000 | 0.050 | 0.030 | — | — | — | 0.005 | — | 649 |
| JJ | 0.320 | 0.01 | 3.7 | 0.010 | 0.0018 | 0.004 | 1.800 | — | — | — | — | 0.008 | — | — | 597 |
| KK | 0.150 | 1.90 | 2.0 | 0.020 | 0.0200 | 0.003 | 0.300 | 0.130 | — | — | — | — | — | Cr: 1.8 | 764 |
| LL | 0.150 | 0.50 | 2.4 | 0.008 | 0.0030 | 0.005 | 0.032 | — | 0.040 | — | — | — | — | — | 682 |
| MM | 0.050 | 0.80 | 0.8 | 0.080 | 0.0020 | 0.008 | 0.040 | 0.020 | 0.130 | 0.002 | — | — | — | — | 862 |
| NN | 0.060 | 0.01 | 1.3 | 0.012 | 0.0020 | 0.003 | 0.300 | 0.022 | — | — | — | — | — | Mo: 0.07 | 802 |
| OO | 0.070 | 0.50 | 2.2 | 0.007 | 0.0040 | 0.003 | 0.035 | — | — | — | — | — | — | — | 737 |
| PP | 0.080 | 1.50 | 2.0 | 0.009 | 0.0010 | 0.004 | 0.500 | — | — | 0.003 | — | — | — | — | 797 |
| QQ | 0.070 | 0.95 | 1.3 | 0.009 | 0.0010 | 0.004 | 0.040 | 0.035 | 0.125 | 0.003 | 0.003 | — | — | V: 0.3 | 811 |
| RR | 0.050 | 0.50 | 1.6 | 0.009 | 0.0030 | 0.002 | 0.200 | — | 0.050 | — | — | 0.005 | — | V: 0.05, B: 0.0005 | 795 |
| SS | 0.120 | 0.08 | 2.2 | 0.008 | 0.0030 | 0.002 | 0.035 | — | — | — | — | — | — | — | 701 |
| aa | 0.380 | 1.20 | 1.4 | 0.020 | 0.0030 | 0.003 | 0.005 | — | 0.120 | — | — | — | — | Cr:2.5 | 651 |
| bb | 0.070 | 0.10 | 4.2 | 0.130 | 0.0025 | 0.003 | 0.030 | — | — | — | — | — | — | — | 628 |
| cc | 0.050 | 1.00 | 1.0 | 0.020 | 0.0030 | 0.003 | 0.035 | 0.200 | — | — | — | — | — | — | 840 |
| dd | 0.020 | 1.00 | 3.0 | 0.010 | 0.0040 | 0.002 | 0.300 | 0.030 | 0.100 | — | — | — | — | — | 740 |
| ee | 0.070 | 1.50 | 1.4 | 0.010 | 0.0700 | 0.003 | 0.030 | — | 0.040 | — | — | — | — | — | 815 |
| ff | 0.060 | 0.10 | 1.1 | 0.008 | 0.0020 | 0.015 | 0.030 | — | 0.200 | — | — | — | — | — | 802 |
| gg | 0.070 | 1.00 | 2.0 | 0.008 | 0.0020 | 0.001 | 0.030 | — | — | 0.020 | — | — | — | — | 790 |

TABLE 6

| SAMPLE No. | STEEL SYMBOL | COLD ROLLING REDUCTION RATIO (%) | COLD-ROLLING SHEET ANNEALING TEMPERATURE (° C.) | COLD-ROLLING SHEET ANNEALING AREA COOLING RATE (° C./s) | INITIAL STRUCTURE AREA FRACTION OF PEARLITE (%) | INITIAL STRUCTURE AVERAGE DIAMETER OF PEARLITE (μm) | INITIAL STRUCTURE AREA FRACTION OF UNRECRYSTALLIZED FERRITE (%) | REHEATING AVERAGE HEATING RATE (° C./s) | REHEATING ACHEVED TEMPERATURE (° C.) | REHEATING HOLDING TIME (s) | REHEATING AVERAGE COOLING RATE (° C./s) | REHEATING COOLING STOP TEMPERATURE (° C.) | PLATING | REMARKS |
|---|---|---|---|---|---|---|---|---|---|---|---|---|---|---|
| 101 | AA | 50 | 800 | 0.5 | 23 | 15.0 | 3 | 35 | 780 | 2 | 120 | 40 | WITH | COMPARATIVE EXAMPLE |
| 102 | AA | 50 | 800 | 4 | 4 | 3.5 | 3 | 35 | 780 | 2 | 60 | 40 | WITHOUT | INVENTION EXAMPLE |
| 103 | AA | 50 | 800 | 4 | 4 | 3.5 | 3 | 120 | 780 | 2 | 120 | 40 | WITHOUT | INVENTION EXAMPLE |
| 104 | BB | 45 | 780 | 6 | 3 | 4.1 | 4 | 2 | 780 | 2 | 120 | 40 | WITHOUT | COMPARATIVE EXAMPLE |
| 105 | BB | 45 | 780 | 6 | 3 | 4.1 | 4 | 35 | 780 | 0 | 60 | 40 | WITH | INVENTION EXAMPLE |
| 106 | BB | 15 | 780 | 6 | 3 | 12.1 | 18 | 35 | 780 | 2 | 60 | 40 | WITHOUT | COMPARATIVE EXAMPLE |
| 107 | CC | 50 | 700 | 4 | 4 | 12.0 | 2 | 35 | 800 | 2 | 120 | 40 | WITH | COMPARATIVE EXAMPLE |
| 108 | CC | 50 | 800 | 4 | 4 | 3.5 | 2 | 120 | 800 | 2 | 120 | 40 | WITHOUT | INVENTION EXAMPLE |
| 109 | CC | 50 | 800 | 4 | 4 | 3.5 | 2 | 35 | 800 | 2 | 60 | 200 | WITHOUT | INVENTION EXAMPLE |
| 110 | DD | 45 | 760 | 10 | 1 | 3.2 | 2 | 35 | 800 | 9 | 60 | 40 | WITH | COMPARATIVE EXAMPLE |
| 111 | DD | 45 | 760 | 10 | 1 | 3.2 | 2 | 35 | 800 | 2 | 60 | 40 | WITHOUT | INVENTION EXAMPLE |
| 112 | DD | 45 | 760 | 10 | 1 | 3.2 | 2 | 8 | 800 | 2 | 120 | 40 | WITHOUT | INVENTION EXAMPLE |
| 113 | EE | 40 | 780 | 6 | 3 | 5.1 | 6 | 120 | 700 | 1 | 150 | 40 | WITHOUT | COMPARATIVE EXAMPLE |
| 114 | EE | 40 | 780 | 6 | 3 | 5.1 | 6 | 120 | 780 | 1 | 150 | 40 | WITHOUT | INVENTION EXAMPLE |
| 115 | EE | 40 | 780 | 6 | 3 | 5.1 | 6 | 120 | 780 | 0 | 150 | 600 | WITHOUT | COMPARATIVE EXAMPLE |
| 116 | FF | 50 | 800 | 4 | 4 | 3.6 | 7 | 120 | 770 | 2 | 150 | 40 | WITH | INVENTION EXAMPLE |
| 117 | FF | 50 | 800 | 4 | 4 | 3.6 | 7 | 35 | 770 | 8 | 70 | 40 | WITHOUT | INVENTION EXAMPLE |
| 118 | GG | 50 | 820 | 8 | 2 | 3.0 | 2 | 35 | 790 | 1 | 70 | 40 | WITH | INVENTION EXAMPLE |
| 119 | GG | 50 | 820 | 8 | 2 | 3.0 | 2 | 120 | 790 | 2 | 200 | 40 | WITHOUT | INVENTION EXAMPLE |

TABLE 6-continued

| SAMPLE No. | STEEL SYMBOL | COLD ROLLING REDUCTION RATIO (%) | COLD-ROLLING SHEET ANNEALING TEMPERATURE (° C.) | COLD-ROLLING SHEET ANNEALING AREA COOLING RATE (° C./s) | INITIAL STRUCTURE AREA FRACTION OF PEARLITE (%) | INITIAL STRUCTURE AVERAGE DIAMETER OF PEARLITE (μm) | INITIAL STRUCTURE AREA FRACTION OF UNRECRYSTALLIZED FERRITE (%) | REHEATING AVERAGE HEATING RATE (° C./s) | REHEATING ACHEVED TEMPERATURE (° C.) | REHEATING HOLDING TIME (s) | REHEATING AVERAGE COOLING RATE (° C./s) | REHEATING COOLING STOP TEMPERATURE (° C.) | PLATING | REMARKS |
|---|---|---|---|---|---|---|---|---|---|---|---|---|---|---|
| 120 | GG | 50 | 820 | 8 | 2 | 3.0 | 2 | 60 | 790 | 4 | 50 | 40 | WITHOUT | COMPARATIVE EXAMPLE |
| 121 | HH | 50 | 780 | 2 | 5 | 3.8 | 2 | 120 | 770 | 2 | 150 | 40 | WITH | INVENTION EXAMPLE |
| 122 | II | 50 | 850 | 4 | 5 | 4.2 | 7 | 120 | 820 | 2 | 150 | 40 | WITHOUT | INVENTION EXAMPLE |
| 123 | JJ | 50 | 850 | 4 | 5 | 4.7 | 2 | 35 | 770 | 2 | 70 | 40 | WITH | INVENTION EXAMPLE |
| 124 | KK | 50 | 850 | 4 | 5 | 4.1 | 8 | 35 | 800 | 2 | 70 | 40 | WITHOUT | INVENTION EXAMPLE |
| 125 | KK | 50 | 850 | 4 | 5 | 4.1 | 8 | 120 | 800 | 2 | 150 | 320 | WITHOUT | COMPARATIVE EXAMPLE |
| 126 | LL | 50 | 850 | 4 | 5 | 4.1 | 2 | 35 | 790 | 2 | 100 | 40 | WITHOUT | INVENTION EXAMPLE |
| 127 | MM | 45 | 800 | 10 | 1 | 3.2 | 4 | 120 | 790 | 2 | 200 | 40 | WITH | INVENTION EXAMPLE |
| 128 | MM | 45 | 800 | 10 | 1 | 3.2 | 4 | 35 | 790 | 2 | 100 | 40 | WITHOUT | INVENTION EXAMPLE |
| 129 | NN | 45 | 820 | 15 | 0 | 3.1 | 4 | 8 | 790 | 2 | 70 | 40 | WITHOUT | INVENTION EXAMPLE |
| 130 | NN | 45 | 820 | 15 | 0 | 3.1 | 4 | 35 | 790 | 2 | 70 | 40 | WITHOUT | INVENTION EXAMPLE |
| 131 | NN | 45 | 820 | 15 | 0 | 3.1 | 4 | 120 | 790 | 2 | 70 | 40 | WITHOUT | INVENTION EXAMPLE |
| 132 | OO | 45 | 800 | 2 | 5 | 4.9 | 2 | 35 | 750 | 1 | 150 | 40 | WITH | COMPARATIVE EXAMPLE |
| 133 | OO | 45 | 800 | 2 | 5 | 4.9 | 2 | 35 | 800 | 1 | 150 | 40 | WITH | INVENTION EXAMPLE |
| 134 | PP | 45 | 820 | 6 | 3 | 4.2 | 2 | 35 | 780 | 1 | 150 | 40 | WITHOUT | INVENTION EXAMPLE |
| 135 | QQ | 50 | 800 | 5 | 3 | 3.3 | 6 | 35 | 780 | 2 | 200 | 40 | WITHOUT | INVENTION EXAMPLE |
| 136 | RR | 45 | 780 | 4 | 4 | 4.3 | 2 | 25 | 780 | 0 | 100 | 300 | WITHOUT | INVENTION EXAMPLE |
| 137 | RR | 45 | 780 | 4 | 4 | 4.3 | 2 | 120 | 780 | 0 | 100 | 300 | WITHOUT | INVENTION EXAMPLE |
| 138 | SS | 45 | 780 | 2 | 5 | 5.0 | 2 | 25 | 770 | 1 | 150 | 300 | WITH | INVENTION EXAMPLE |
| 139 | aa | 50 | 760 | 4 | 18 | 13.0 | 2 | 30 | 770 | 0 | 100 | 450 | WITH | COMPARATIVE EXAMPLE |

TABLE 6-continued

| | | COLD-ROLLING | | | INITIAL STRUCTURE | | | REHEATING | | | | | | |
|---|---|---|---|---|---|---|---|---|---|---|---|---|---|---|
| | | COLD | SHEET ANNEALING | | AREA | AVERAGE | AREA FRACTION OF | | | | | COOLING | | |
| SAMPLE No. | STEEL SYMBOL | ROLLING REDUCTION RATIO (%) | TEMPERATURE (° C.) | AREA COOLING RATE (° C./s) | FRACTION OF PEARLITE (%) | DIAMETER OF PEARLITE (μm) | UNRECRYSTALLIZED FERRITE (%) | AVERAGE HEATING RATE (° C./s) | ACHEVED TEMPERATURE (° C.) | HOLDING TIME (s) | AVERAGE COOLING RATE (° C./s) | STOP TEMPERATURE (° C.) | PLATING | REMARKS |
| 140 | bb | 50 | 760 | 4 | 4 | 3.3 | 22 | 60 | 770 | 0 | 100 | 450 | WITHOUT | COMPARATIVE EXAMPLE |
| 141 | cc | 50 | 760 | 4 | 4 | 3.2 | 22 | 30 | 770 | 0 | 100 | 450 | WITHOUT | COMPARATIVE EXAMPLE |
| 142 | dd | 50 | 760 | 4 | 3 | 3.1 | 5 | 60 | 770 | 0 | 100 | 450 | WITHOUT | COMPARATIVE EXAMPLE |
| 143 | ee | 50 | 760 | 4 | 4 | 3.3 | 2 | 30 | 800 | 0 | 100 | 450 | WITH | COMPARATIVE EXAMPLE |
| 144 | ff | 50 | 760 | 4 | 4 | 3.2 | 16 | 60 | 800 | 0 | 100 | 450 | WITHOUT | COMPARATIVE EXAMPLE |
| 145 | gg | 50 | 760 | 4 | 4 | 3.3 | 2 | 30 | 770 | 0 | 100 | 450 | WITHOUT | COMPARATIVE EXAMPLE |
| 146 | CC | 70 | 760 | 0.5 | 12 | 2.6 | 1 | 60 | 800 | 7 | 150 | 270 | WITHOUT | COMPARATIVE EXAMPLE |
| 147 | CC | 50 | 800 | 4 | 4 | 3.5 | 2 | 130 | 800 | 7 | 150 | 270 | WITHOUT | COMPARATIVE EXAMPLE |
| 148 | CC | 50 | 800 | 4 | 4 | 3.5 | 2 | 60 | 830 | 7 | 150 | 270 | WITHOUT | COMPARATIVE EXAMPLE |
| 149 | CC | 50 | 800 | 4 | 4 | 3.5 | 2 | 60 | 770 | 0 | 150 | 270 | WITHOUT | INVENTION EXAMPLE |

For each of the high-strength steel sheets, the microstructure was identified and configuration of martensite was identified. These results are presented in Table 7. An underlines in Table 7 indicates that the item deviates from a range of the present invention.

TABLE 7

| | | MICROSTRUCTURE (AREA %) | | | | CONFIGURATION OF RATIO OF | | | |
|---|---|---|---|---|---|---|---|---|---|
| SAMPLE No. | STEEL SYMBOL | MARTENSITE | FERRITE | PEARLITE | UNCRYS-TALLIZED FERRITE | AVERAGE DIAMETER (μm) | BULGING TYPE (%) | AREA RATIO | REMARKS |
| 101 | AA | 4 | 70 | 9 | 3 | 1.4 | 86 | 1.2 | COMPARATIVE EXAMPLE |
| 102 | AA | 10 | 77 | 1 | 3 | 1.7 | 86 | 1.2 | INVENTION EXAMPLE |
| 103 | AA | 15 | 68 | 1 | 3 | 1.5 | 86 | 1.2 | INVENTION EXAMPLE |
| 104 | BB | 23 | 58 | 1 | 4 | 10.4 | 85 | 1.1 | COMPARATIVE EXAMPLE |
| 105 | BB | 27 | 55 | 1 | 4 | 2.2 | 84 | 1.2 | INVENTION EXAMPLE |
| 106 | BB | 22 | 55 | 6 | 18 | 3.5 | 86 | 1.2 | COMPARATIVE EXAMPLE |
| 107 | CC | 8 | 74 | 6 | 2 | 2.0 | 88 | 1.2 | COMPARATIVE EXAMPLE |
| 108 | CC | 17 | 66 | 1 | 2 | 1.6 | 88 | 1.2 | INVENTION EXAMPLE |
| 109 | CC | 12 | 74 | 1 | 2 | 1.9 | 88 | 1.2 | INVENTION EXAMPLE |
| 110 | DD | 14 | 74 | 0 | 2 | 4.1 | 35 | 1.3 | COMPARATIVE EXAMPLE |
| 111 | DD | 14 | 74 | 0 | 2 | 2.0 | 88 | 1.2 | INVENTION EXAMPLE |
| 112 | DD | 10 | 76 | 0 | 2 | 2.9 | 88 | 1.2 | INVENTION EXAMPLE |
| 113 | EE | 4 | 70 | 11 | 6 | 1.1 | 7 | 0.5 | COMPARATIVE EXAMPLE |
| 114 | EE | 33 | 43 | 1 | 6 | 2.0 | 85 | 1.2 | INVENTION EXAMPLE |
| 115 | EE | 19 | 43 | 15 | 6 | 1.4 | 84 | 1.2 | COMPARATIVE EXAMPLE |
| 116 | FF | 32 | 45 | 1 | 7 | 2.0 | 85 | 1.2 | INVENTION EXAMPLE |
| 117 | FF | 28 | 53 | 1 | 7 | 2.8 | 75 | 1.2 | INVENTION EXAMPLE |
| 118 | GG | 45 | 30 | 1 | 2 | 2.6 | 86 | 1.2 | INVENTION EXAMPLE |
| 119 | GG | 48 | 21 | 1 | 2 | 2.6 | 87 | 1.2 | INVENTION EXAMPLE |
| 120 | GG | 3 | 27 | 20 | 2 | 1.3 | 90 | 1.2 | COMPARATIVE EXAMPLE |
| 121 | HH | 15 | 67 | 1 | 2 | 1.6 | 85 | 1.2 | INVENTION EXAMPLE |
| 122 | II | 49 | 21 | 1 | 7 | 1.3 | 91 | 1.3 | INVENTION EXAMPLE |
| 123 | JJ | 24 | 57 | 1 | 2 | 2.3 | 85 | 1.2 | INVENTION EXAMPLE |
| 124 | KK | 45 | 30 | 1 | 8 | 2.9 | 88 | 1.2 | INVENTION EXAMPLE |
| 125 | KK | 4 | 21 | 1 | 8 | 0.9 | 89 | 1.3 | COMPARATIVE EXAMPLE |
| 126 | LL | 51 | 22 | 0 | 2 | 2.4 | 87 | 1.2 | INVENTION EXAMPLE |
| 127 | MM | 26 | 52 | 0 | 4 | 1.8 | 87 | 1.2 | INVENTION EXAMPLE |
| 128 | MM | 22 | 61 | 0 | 4 | 2.1 | 87 | 1.2 | INVENTION EXAMPLE |
| 129 | NN | 9 | 78 | 1 | 4 | 2.7 | 87 | 1.2 | INVENTION EXAMPLE |
| 130 | NN | 11 | 76 | 1 | 4 | 1.7 | 87 | 1.2 | INVENTION EXAMPLE |
| 131 | NN | 17 | 67 | 1 | 4 | 1.5 | 87 | 1.2 | INVENTION EXAMPLE |
| 132 | OO | 4 | 92 | 1 | 2 | 1.4 | 20 | 0.4 | COMPARATIVE EXAMPLE |
| 133 | OO | 25 | 54 | 1 | 2 | 2.3 | 87 | 1.2 | INVENTION EXAMPLE |
| 134 | PP | 7 | 77 | 1 | 2 | 1.5 | 83 | 1.2 | INVENTION EXAMPLE |
| 135 | QQ | 21 | 58 | 1 | 6 | 2.1 | 84 | 1.2 | INVENTION EXAMPLE |
| 136 | RR | 23 | 70 | 1 | 2 | 2.4 | 82 | 1.1 | INVENTION EXAMPLE |
| 137 | RR | 23 | 70 | 1 | 2 | 1.6 | 82 | 1.2 | INVENTION EXAMPLE |
| 138 | SS | 8 | 63 | 4 | 2 | 1.9 | 84 | 1.2 | INVENTION EXAMPLE |
| 139 | aa | 65 | 15 | 0 | 2 | 4.0 | 81 | 1.1 | COMPARATIVE EXAMPLE |
| 140 | bb | 32 | 17 | 0 | 22 | 2.2 | 81 | 1.1 | COMPARATIVE EXAMPLE |
| 141 | cc | 36 | 55 | 0 | 22 | 2.5 | 83 | 1.1 | COMPARATIVE EXAMPLE |
| 142 | dd | 4 | 95 | 0 | 5 | 1.1 | 84 | 1.2 | COMPARATIVE EXAMPLE |
| 143 | ee | 12 | 85 | 0 | 2 | 1.8 | 86 | 1.2 | COMPARATIVE EXAMPLE |
| 144 | ff | 24 | 70 | 0 | 16 | 1.8 | 86 | 1.2 | COMPARATIVE EXAMPLE |
| 145 | gg | 28 | 65 | 0 | 2 | 2.5 | 81 | 1.1 | COMPARATIVE EXAMPLE |
| 146 | CC | 3 | 72 | 1 | 1 | 1.8 | 57 | 0.8 | COMPARATIVE EXAMPLE |
| 147 | CC | 3 | 70 | 1 | 2 | 1.5 | 44 | 0.7 | COMPARATIVE EXAMPLE |
| 148 | CC | 13 | 70 | 1 | 2 | 4.1 | 40 | 0.6 | COMPARATIVE EXAMPLE |
| 149 | CC | 11 | 73 | 1 | 2 | 1.4 | 70 | 1.0 | INVENTION EXAMPLE |

Further, a tensile test was conducted on each of the high-strength steel sheets according to JIS Z 2241, and the tensile strength TS, the elongation EL, and the reduction of area RA were measured. These results are resented in Table 8. An underline in Table 8 indicates that the value deviates from a desirable range.

TABLE 8

| | | MECHANICAL PROPERTIES | | | | |
|---|---|---|---|---|---|---|
| SAMPLE No. | STEEL SYMBOL | TENSILE STRENGTH TS ($N/mm^2$) | ELONGATION EL (%) | TS × EL ($N/mm^2$ %) | REDUCTION OF AREA RA | REMARKS |
| 101 | AA | 565 | 25.2 | 14241 | 0.29 | COMPARATIVE EXAMPLE |
| 102 | AA | 599 | 32.5 | 19483 | 0.59 | INVENTION EXAMPLE |
| 103 | AA | 621 | 31.4 | 19505 | 0.58 | INVENTION EXAMPLE |
| 104 | BB | 795 | 21.0 | 16695 | 0.40 | COMPARATIVE EXAMPLE |
| 105 | BB | 816 | 23.3 | 18990 | 0.54 | INVENTION EXAMPLE |
| 106 | BB | 791 | 21.5 | 17013 | 0.27 | COMPARATIVE EXAMPLE |
| 107 | CC | 599 | 25.0 | 14974 | 0.31 | COMPARATIVE EXAMPLE |
| 108 | CC | 644 | 30.6 | 19739 | 0.58 | INVENTION EXAMPLE |
| 109 | CC | 622 | 31.7 | 19721 | 0.59 | INVENTION EXAMPLE |
| 110 | DD | 631 | 24.3 | 15323 | 0.38 | COMPARATIVE EXAMPLE |
| 111 | DD | 631 | 31.2 | 19648 | 0.60 | INVENTION EXAMPLE |
| 112 | DD | 611 | 32.2 | 19694 | 0.60 | INVENTION EXAMPLE |
| 113 | EE | 728 | 21.0 | 15281 | 0.10 | COMPARATIVE EXAMPLE |
| 114 | EE | 871 | 23.0 | 20027 | 0.53 | INVENTION EXAMPLE |
| 115 | EE | 802 | 21.2 | 17003 | 0.19 | COMPARATIVE EXAMPLE |
| 116 | FF | 858 | 22.8 | 19525 | 0.53 | INVENTION EXAMPLE |
| 117 | FF | 837 | 22.4 | 18750 | 0.56 | INVENTION EXAMPLE |
| 118 | GG | 965 | 20.5 | 19813 | 0.50 | INVENTION EXAMPLE |
| 119 | GG | 979 | 20.3 | 19848 | 0.50 | INVENTION EXAMPLE |
| 120 | GG | 752 | 20.0 | 15032 | 0.33 | COMPARATIVE EXAMPLE |
| 121 | HH | 642 | 29.8 | 19117 | 0.58 | INVENTION EXAMPLE |
| 122 | II | 1277 | 15.5 | 19841 | 0.51 | INVENTION EXAMPLE |
| 123 | JJ | 736 | 25.9 | 19072 | 0.55 | INVENTION EXAMPLE |
| 124 | KK | 960 | 19.8 | 19045 | 0.51 | INVENTION EXAMPLE |
| 125 | KK | 753 | 19.0 | 14298 | 0.38 | COMPARATIVE EXAMPLE |
| 126 | LL | 1135 | 18.0 | 20457 | 0.50 | INVENTION EXAMPLE |
| 127 | MM | 755 | 25.0 | 18844 | 0.56 | INVENTION EXAMPLE |
| 128 | MM | 736 | 25.6 | 18839 | 0.57 | INVENTION EXAMPLE |
| 129 | NN | 595 | 32.5 | 19364 | 0.60 | INVENTION EXAMPLE |
| 130 | NN | 605 | 31.9 | 19289 | 0.59 | INVENTION EXAMPLE |
| 131 | NN | 637 | 30.4 | 19336 | 0.58 | INVENTION EXAMPLE |
| 132 | OO | 699 | 23.0 | 16072 | 0.20 | COMPARATIVE EXAMPLE |
| 133 | OO | 803 | 24.0 | 19279 | 0.55 | INVENTION EXAMPLE |
| 134 | PP | 587 | 31.4 | 18424 | 0.59 | INVENTION EXAMPLE |
| 135 | QQ | 765 | 25.6 | 19612 | 0.56 | INVENTION EXAMPLE |
| 136 | RR | 673 | 28.9 | 19464 | 0.55 | INVENTION EXAMPLE |
| 137 | RR | 673 | 28.8 | 19383 | 0.55 | INVENTION EXAMPLE |
| 138 | SS | 797 | 24.9 | 19845 | 0.56 | INVENTION EXAMPLE |
| 139 | aa | 700 | 14.0 | 9794 | 0.21 | COMPARATIVE EXAMPLE |
| 140 | bb | 1104 | 7.7 | 8497 | 0.29 | COMPARATIVE EXAMPLE |
| 141 | cc | 956 | 9.8 | 9374 | 0.29 | COMPARATIVE EXAMPLE |
| 142 | dd | 439 | 37.0 | 16248 | 0.44 | COMPARATIVE EXAMPLE |
| 143 | ee | 611 | 15.5 | 9471 | 0.36 | COMPARATIVE EXAMPLE |
| 144 | ff | 642 | 13.0 | 8341 | 0.33 | COMPARATIVE EXAMPLE |
| 145 | gg | 790 | 11.3 | 8926 | 0.30 | COMPARATIVE EXAMPLE |
| 146 | CC | 564 | 25.1 | 14155 | 0.34 | COMPARATIVE EXAMPLE |
| 147 | CC | 609 | 27.7 | 16873 | 0.31 | COMPARATIVE EXAMPLE |
| 148 | CC | 635 | 26.5 | 16838 | 0.27 | COMPARATIVE EXAMPLE |
| 149 | CC | 612 | 29.2 | 17284 | 0.47 | INVENTION EXAMPLE |

As presented in Table 8, as for sample No. 102 to No. 103, No. 105, No. 108 to No. 109, No. 111-No. 112, No. 114, No. 116-No. 119, No. 121-No. 124, No. 126 to No. 131, No. 133 to No. 138, and No. 149, excellent tensile strength and reduction of area were obtained, and the balance between the tensile strength and the elongation was also good.

On the other hand, as for sample No. 101, the area fraction of pearlite was too high and the average diameter of the pearlite grains was too large in the steel sheet, the area fraction of martensite was too low and the area fraction of pearlite was too high in the high-strength steel sheet. For this reason, good product (TS×EL) and reduction of area RA could not be obtained. The reason why the area fraction of pearlite in the steel sheet was too high and the average diameter of the pearlite grains was too large is that the average cooling rate of cold-rolled sheet annealing was too low.

As for sample No. 104, since the average heating rate of reheating was low, the average diameter of the martensite grains in the high-strength steel sheet was too large. For this reason, good product (TS×EL) and reduction of area RA could not be obtained.

As for sample No. 106, since the average diameter of the pearlite grains was too large and the area fraction of unrecrystallized ferrite was too high in the steel sheet, the area fraction of pearlite was too high and the average diameter of the martensite grains was too large in the high-strength steel sheet. For this reason, good product (TS×EL) and reduction of area RA could not be obtained. The reason why the average diameter of pearlite in the steel sheet was too large and the area fraction of unrecrystallized ferrite was too high is that the rolling reduction of cold rolling was too low.

As for sample No. 107, since the average diameter of the pearlite grains in the steel sheet was large, the area fraction of pearlite in the high-strength steel sheet was too high. For this reason, good product (TS×EL) and reduction of area RA could not be obtained. The reason why the average diameter of pearlite in the steel sheet was too large is that the temperature of cold-rolled sheet annealing was too low.

As for sample No. 110, since the holding time of reheating was too long, the average diameter of the martensite grains in the high-strength steel sheet was too large. For this reason, good product (TS×EL) and reduction of area RA could not be obtained.

As for sample No. 113, the achieved temperature of reheating was too low, the area fraction of martensite was too low, the pearlite area fraction was too high, and the ratio of bulging type martensite grains was too low in the high-strength steel sheet. For this reason, good product (TS×EL) and reduction of area RA could not be obtained.

As for sample No. 115, since the cooling stop temperature of reheating was too high, the area fraction of pearlite in the high-strength steel sheet was too high. For this reason, good product (TS×EL) and reduction of area RA could not be obtained.

As for sample No. 120, the average cooling rate of reheating was too low, the area fraction of martensite was too low and the area fraction of pearlite was too high in the high-strength steel sheet. For this reason, good product (TS×EL) and reduction of area RA could not be obtained.

As for sample No. 125, since the cooling stop temperature of reheating was too high, the area fraction of martensite in the high-strength steel sheet was too low. For this reason, good product (TS×EL) and reduction of area RA could not be obtained.

As for sample No. 132, since the achieved temperature of reheating was too low, the area fraction of martensite was too low and the ratio of bulging type martensite grains was too low in the high-strength steel sheet. For this reason, good product (TS×EL) and reduction of area RA could not be obtained.

As for sample No. 138-sample No. 145, since the chemical composition was out of the range of the present invention, good product (TS×EL) and reduction of area RA could not be obtained.

As for sample No. 146, since the area fraction of pearlite in the steel sheet was too high, the area fraction of martensite was too low, the ratio of bulging type martensite grains was too low and the specific area ratio was too low in the high-strength steel sheet. For this reason, good product (TS×EL) and reduction of area RA could not be obtained. The reason why the area fraction of pearlite in the steel sheet was too high is that the average cooling rate of cold-rolled sheet annealing was too low.

As for sample No. 147, since the average heating rate of reheating was too high, the area fraction of martensite was too low, the ratio of bulging type martensite grains was too low and the specific area ratio was too low in the high-strength steel sheet. For this reason, good product (TS×EL) and reduction of area RA could not be obtained.

As for sample No. 148, since the achieved temperature of reheating was too high, the average diameter of martensite was too large, the ratio of bulging type martensite grains was too low and the specific area ratio was too low in the high-strength steel sheet. For this reason, good product (TS×EL) and reduction of area RA could not be obtained.

Figure 9:
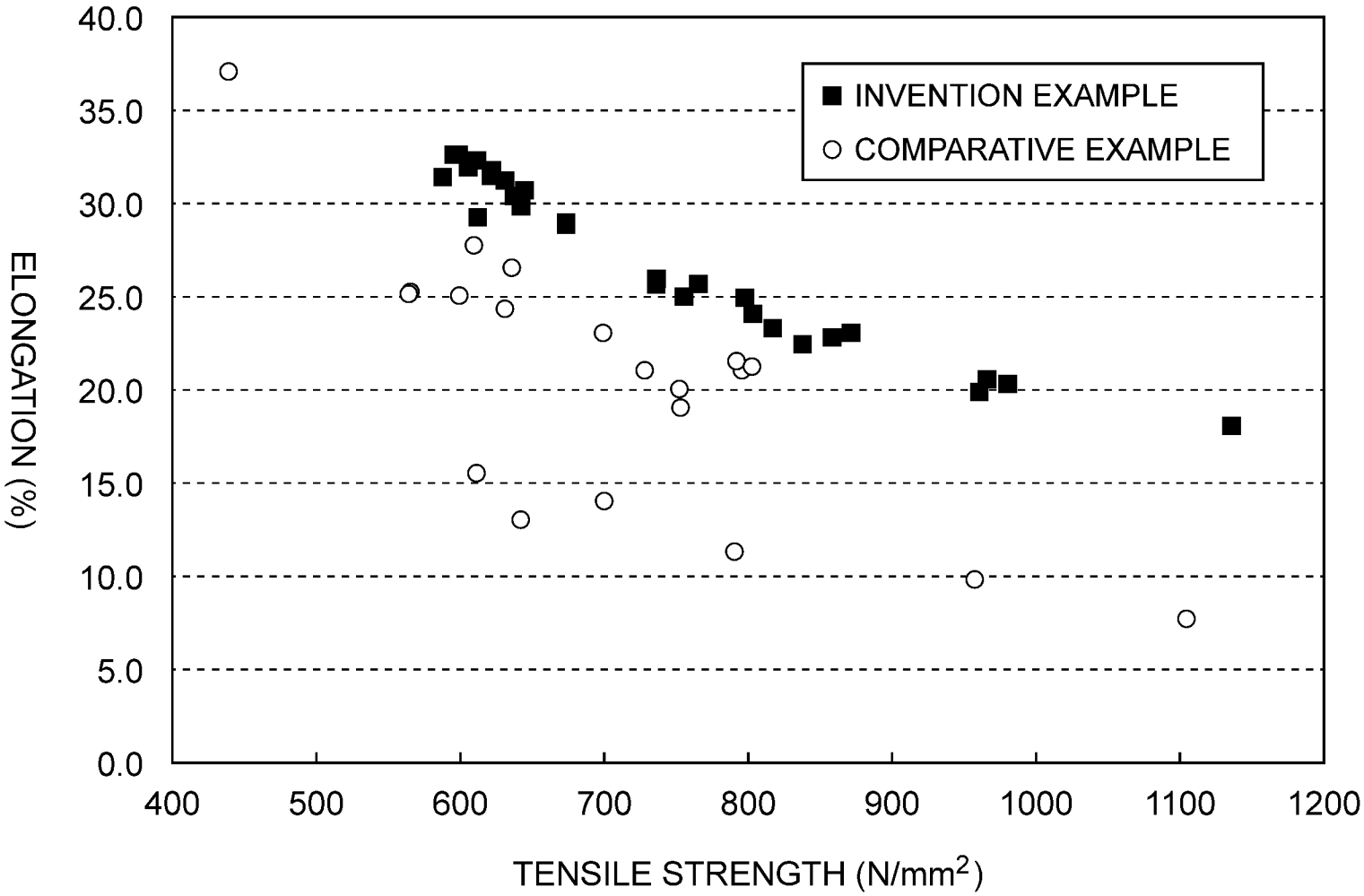
FIG. 9 is a diagram illustrating a relationship between tensile strength and elongation in a second experiment.
Figure 10:
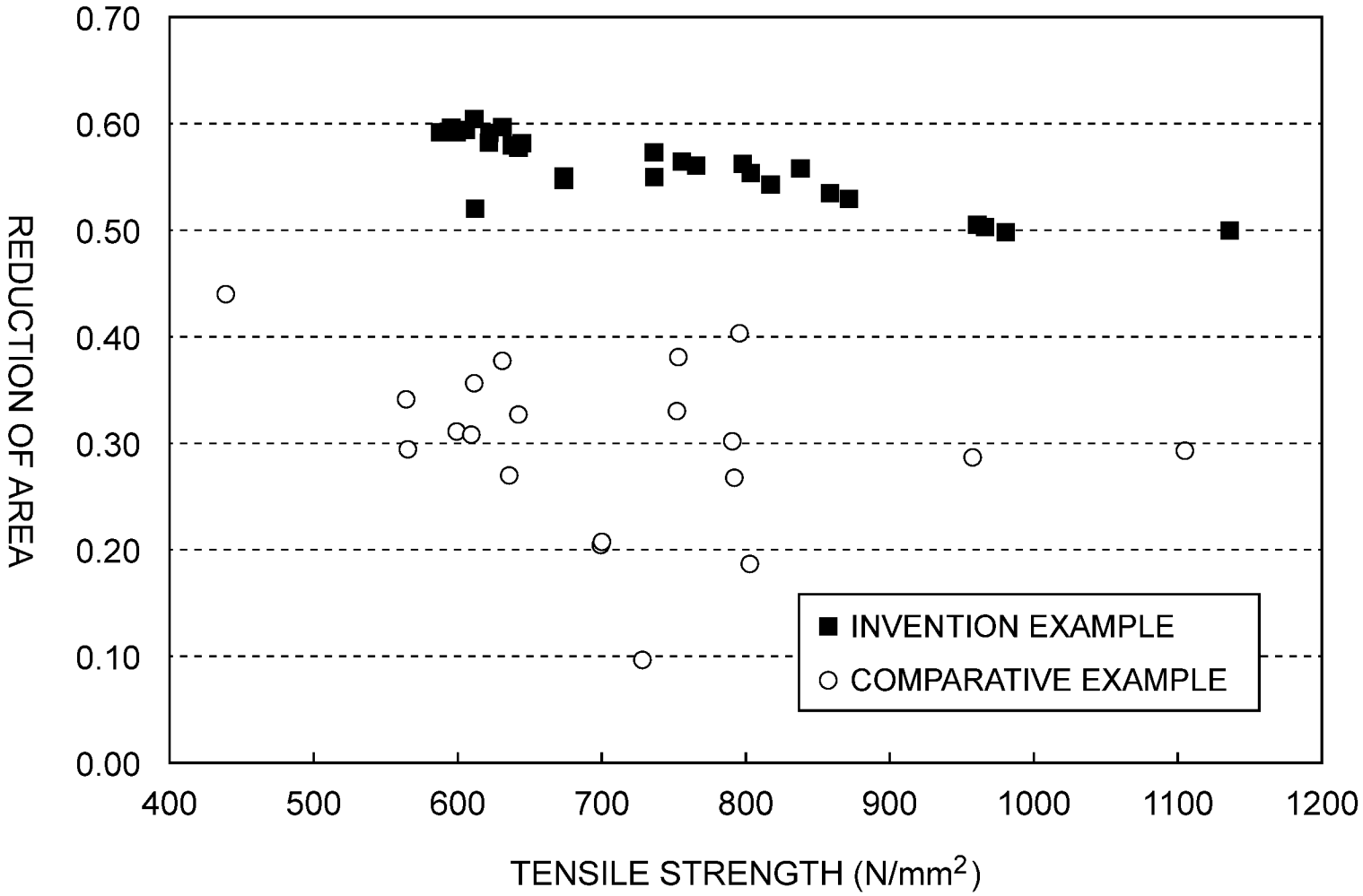
FIG. 10 is a diagram illustrating a relationship between the tensile strength and reduction of area in the second experiment.

FIG. 9 illustrates the relationship between the tensile strength and the elongation of the invention examples and comparative examples, and FIG. 10 illustrates the relationship between the tensile strength and the reduction of area. As illustrated in FIG. 9, if the tensile strength was substantially equal, the higher elongation could be obtained in the invention examples. As illustrated in FIG. 10, if the tensile strength was substantially equal, the excellent reduction of area could be obtained in the invention examples.

INDUSTRIAL APPLICABILITY

The present invention can be applied to, for example, industries related to a high-strength steel sheet suitable for automotive parts.

The invention claimed is:

1. A high-strength steel sheet, comprising:

a chemical composition represented by, in mass %:

C: 0.03% to 0.35%;
Si: 0.01% to 2.0%;
Mn: 0.3% to 4.0%;
Al: 0.01% to 2.0%;
P: 0.10% or less;
S: 0.05% or less;
N: 0.010% or less;
Cr: 0.0% to 3.0%;
Mo: 0.0% to 1.0%;
Ni: 0.0% to 3.0%;
Cu: 0.0% to 3.0%;
Nb: 0.0% to 0.3%;
Ti: 0.0% to 0.3%;
V: 0.0% to 0.5%;
B: 0.0% to 0.1%;
Ca: 0.00% to 0.01%;
Mg: 0.00% to 0.01%;
Zr: 0.00% to 0.01%;
REM: 0.00% to 0.01%; and
a balance: Fe and impurities, and a microstructure represented by, in area %, martensite: 5% or more;
ferrite: 20% or more; and
pearlite: 5% or less, wherein an average diameter of each martensite grain is 4 μm or less in equivalent circle diameter, a ratio of a number of bulging type martensite grains to a number of martensite grains on grain boundary triple points of a matrix is 70% or more, wherein:

the bulging type martensite grains are on one of the grain boundary triple points of the matrix; and at least one of all grain boundaries of the bulging type martensite grains, which are grain boundaries connecting two adjacent grain boundary triple points of the bulging type martensite grains and grains of the matrix, has a convex curvature to an outer side with respect to line segments connecting the two adjacent grain boundary triple points, and an area ratio represented by VM/A0 is 1.0 or more, wherein:

VM denotes a total area of the martensite grains on the grain boundary triple points of the matrix; and A0 denotes a total area of polygons comprising the line segments connecting two adjacent grain boundary triple points of the martensite grains.

2. The high-strength steel sheet according to claim 1, wherein an average diameter $D_S$ of ferrite in a surface layer portion from a surface of the high-strength steel sheet to a depth $4\times D_0$ is not more than twice an average diameter $D_0$, wherein the average diameter $D_0$ is an average diameter of ferrite in a region where a depth from the surface of the high-strength steel sheet is ¼ of a thickness of the high-strength steel sheet.

3. The high-strength steel sheet according to claim 1, wherein an area fraction of unrecrystallized ferrite is 10% or less in the microstructure.

4. The high-strength steel sheet according to claim 1, wherein, in the chemical composition, Cr: 0.05% to 3.0%,
Mo: 0.05% to 1.0%,
Ni: 0.05% to 3.0%, or
Cu: 0.05% to 3.0%,
or any combination thereof is satisfied.

5. The high-strength steel sheet according to claim 1, wherein, in the chemical composition, Nb: 0.005% to 0.3%,
Ti: 0.005% to 0.3%, or
V: 0.01% to 0.5%,
or any combination thereof is satisfied.

6. The high-strength steel sheet according to claim 1, wherein, in the chemical composition, B: 0.0001% to 0.1% is satisfied.

7. The high-strength steel sheet according to claim 1, wherein, in the chemical composition, Ca: 0.0005% to 0.01%,
Mg: 0.0005% to 0.01%,
Zr: 0.0005% to 0.01%, or
REM: 0.0005% to 0.01%,
or any combination thereof is satisfied.

8. A high-strength steel sheet according to claim 4, further comprising a hot-dip galvanized layer.

9. A method of manufacturing the high-strength steel sheet according to claim 4, comprising the steps of:

preparing a steel sheet;

reheating the steel sheet to a first temperature of 770° C. to 820° C. at an average heating rate of 3° C./s to 120° C./s; and then, cooling the steel sheet to a second temperature of 300° C. or less at an average cooling rate of 60° C./s or more, wherein an area fraction of pearlite is 10% or less, an area fraction of unrecrystallized ferrite is 10% or less, and an average diameter of pearlite grain is 10 μm or less in the steel sheet, an average diameter $D_S$ of ferrite in a surface layer portion from a surface of the steel sheet to a depth $4\times D_0$ is not more than twice an average diameter $D_0$, wherein the average diameter $D_0$ is an average diameter of ferrite in a region where a depth from the surface of the steel sheet is ¼ of a thickness of the steel sheet, the cooling to the second temperature is started within 8 seconds once the temperature of the steel sheet reaches the first temperature, and the steel sheet comprises a chemical composition represented by, in mass %:

C: 003% to 0.35%;
Si: 0.01% to 2.0%;
Mn: 0.3% to 4.0%;
Al: 0.01% to 2.0%;
P: 0.10% or less;
S: 0.05% or less;
N: 0.010% or less;
Cr: 0.0% to 3.0%;
Mo: 0.0% to 1.0%;
Ni: 0.0% to 3.0%;
Cu: 0.0% to 3.0%;
Nb: 0.0% to 0.3%;
Ti: 0.0% to 0.3%;
V: 0.0% to 0.5%;
B: 0.0% to 0.1%;
Ca: 0.00% to 0.01%;
Mg: 0.00% to 0.01%;
Zr: 0.00% to 0.01%;
REM: 0.00% to 0.01%; and
the balance: Fe and impurities, and a microstructure represented by, in area %, martensite: 5% or more;
ferrite: 20% or more; and
perlite: 5% or less, wherein an average diameter of martensite grain is 4 μm or less in equivalent circle diameter, a ratio of the number of bulging type martensite grains to the number of martensite grains on grain boundary triple points of a matrix is 70% or more, wherein:

the bulging type martensite grain is on one of the grain boundary triple points of the matrix; and at least one of grain boundaries of the bulging type martensite grain, the grain boundaries connecting two adjacent grain boundary triple points of the bulging type martensite grain and grains of the matrix; has a convex curvature to an outer side with respect to line segments connecting the two adjacent grain boundary triple points, and an area ratio represented by VM/A0 is 1.0 or more, wherein:

VM denotes a total area of the martensite grains on the grain boundary triple points of the matrix; and A0 denotes a total area of polygons composed of the line segments connecting two adjacent grain boundary triple points of the martensite grains.

10. The method of manufacturing the high-strength steel sheet according to claim 9, wherein the step of preparing the steel sheet comprises the step of hot-rolling and cooling a slab.

11. The method of manufacturing the high-strength steel sheet according to claim 10, wherein a rolling temperature is "Ar3 point+10° C." to 1000° C., and a total reduction ratio is 15% or more in last two stands of finish rolling in the hot rolling, and a cooling stop temperature is 550° C. or lower of the cooling in the step of preparing the steel sheet.

12. The method of manufacturing the high-strength steel sheet according to claim 9, wherein the step of preparing the steel sheet comprises the steps of:

hot rolling a slab to obtain a hot-rolled steel sheet; and cold rolling, annealing and cooling the hot-rolled steel sheet.

13. The method of manufacturing the high-strength steel sheet according to claim 12, wherein a reduction ratio in the cold rolling is 30% or more, a temperature of the annealing is 130° C. to 900° C., and an average cooling rate from the temperature of the annealing to 600° C. is 1.0° C./s to 20° C./second in cooling in the step of preparing the steel sheet.

14. The method of manufacturing the high-strength steel sheet according to claim 9, wherein, in the chemical composition, Cr: 0.05% to 3.0%,
Mo: 0.05% to 1.0%,
Ni: 0.05% to 3.0%, or
Cu: 0.05% to 3.0%,
or any combination thereof is satisfied.

15. The method of manufacturing the high-strength steel sheet according to claim 9, wherein, in the chemical composition, Nb: 0.005% to 0.3%,
Ti: 0.005% to 0.3%, or
V: 0.01% to 0.5%,
or any combination thereof is satisfied.

16. The method of manufacturing the high-strength steel sheet according to claim 9, wherein, in the chemical composition, B: 0,0001% to 0.1% is satisfied.

17. The method of manufacturing the high-strength steel sheet according to claim 9, wherein, in the chemical composition, Ca: 0.0005% to 0.01%,
Mg: 0.0005% to 0.01%,
Zr: 0.0005% to 0.01%, or
REM: 0.0005% to 0.01%,
or any combination thereof is satisfied.

* * * * *